US012162709B2

(12) United States Patent
Mochizuki et al.

(10) Patent No.: US 12,162,709 B2
(45) Date of Patent: Dec. 10, 2024

(54) IMAGE FORMING APPARATUS

(71) Applicants: Takato Mochizuki, Kanagawa (JP); Kentaroh Fukami, Kanagawa (JP); Yuuki Nakagawa, Kanagawa (JP); Atsushi Kuriyama, Kanagawa (JP); Yusuke Tanaka, Kanagawa (JP); Akikazu Iwata, Kanagawa (JP); Yasuo Ohba, Kanagawa (JP); Hiroki Yoshida, Kanagawa (JP); Takuya Fukuhara, Kanagawa (JP); Ryoh Suzuki, Kanagawa (JP)

(72) Inventors: Takato Mochizuki, Kanagawa (JP); Kentaroh Fukami, Kanagawa (JP); Yuuki Nakagawa, Kanagawa (JP); Atsushi Kuriyama, Kanagawa (JP); Yusuke Tanaka, Kanagawa (JP); Akikazu Iwata, Kanagawa (JP); Yasuo Ohba, Kanagawa (JP); Hiroki Yoshida, Kanagawa (JP); Takuya Fukuhara, Kanagawa (JP); Ryoh Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 17/854,637

(22) Filed: Jun. 30, 2022

(65) Prior Publication Data

US 2023/0024014 A1 Jan. 26, 2023

(30) Foreign Application Priority Data

Jul. 26, 2021 (JP) ..... 2021-121655

(51) Int. Cl.
*B65H 29/60* (2006.01)
*B65H 5/00* (2006.01)
(Continued)

(52) U.S. Cl.
CPC ..... *B65H 29/60* (2013.01); *B65H 5/006* (2013.01); *B65H 5/36* (2013.01); *B65H 29/52* (2013.01);
(Continued)

(58) Field of Classification Search
CPC . B65H 5/36; B65H 5/38; B65H 29/52; B65H 29/58; B65H 29/60; B65H 85/00;
(Continued)

(56) References Cited

U.S. PATENT DOCUMENTS

2012/0313309 A1 12/2012 Yoshida et al.
2014/0364295 A1* 12/2014 Watanabe ..... B65H 45/14 493/436
(Continued)

FOREIGN PATENT DOCUMENTS

| | | |
|---|---|---|
| JP | 2010-006524 | 1/2010 |
| JP | 2015-016975 | 1/2015 |
| JP | 2019-163165 | 9/2019 |

OTHER PUBLICATIONS

Merriam-Webster Dictionary, printed Mar. 29, 2024, p. 2 of PDF (Year: 2024).*

*Primary Examiner* — Prasad V Gokhale
(74) *Attorney, Agent, or Firm* — Harness, Dickey & Pierce, P.L.C.

(57) ABSTRACT

A post-processing apparatus includes a first conveyor, a second conveyor, a third conveyor, and a conveyance passage corrector. The first conveyor conveys a sheet conveyed along a first conveyance passage downstream from the first conveyor. The second conveyor conveys the sheet along a second conveyance passage. The third conveyor conveys the sheet along a third conveyance passage. The conveyance passage corrector includes a retracting mechanism to retract from a joining position at which the third conveyance passage joins to the first conveyance passage and turns a
(Continued)

conveyance direction of the sheet toward the first conveyor when the sheet enters from the third conveyance passage to the first conveyance passage.

8 Claims, 23 Drawing Sheets

(51) Int. Cl.
*B65H 5/36* (2006.01)
*B65H 29/52* (2006.01)

(52) U.S. Cl.
CPC .... *B65H 2301/121* (2013.01); *B65H 2404/56* (2013.01); *B65H 2601/11* (2013.01); *B65H 2801/03* (2013.01)

(58) Field of Classification Search
CPC ..... B65H 2404/56; B65H 2404/61; B65H 2404/63; B65H 2404/632; B65H 2601/11; B65H 2801/27
See application file for complete search history.

(56) References Cited

U.S. PATENT DOCUMENTS

| | | | | |
|---|---|---|---|---|
| 2015/0329308 | A1 | 11/2015 | Iwata et al. | |
| 2019/0284011 | A1* | 9/2019 | Furuhashi | B65H 9/002 |
| 2020/0071118 | A1 | 3/2020 | Sawada | |
| 2020/0183311 | A1* | 6/2020 | Sakurai | B65H 5/36 |
| 2021/0032055 | A1* | 2/2021 | Uehara | B65H 1/04 |
| 2021/0214180 | A1* | 7/2021 | Ikegami | G03G 21/1633 |
| 2022/0063953 | A1 | 3/2022 | Tanaka et al. | |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2021-121655, filed on Jul. 26, 2021, in the Japan Patent Office, the entire disclosure of which is hereby incorporated by reference herein.

BACKGROUND

Technical Field

Embodiments of this disclosure relate to a post-processing apparatus, and an image forming apparatus and an image forming system incorporating the post-processing apparatus.

Related Art

In the related art, a post-processing apparatus that performs an alignment process and a folding process is known. In the alignment process, the post-processing apparatus overlays a plurality of sheets as sheet-shaped media and aligns end portions of the plurality of sheets. In the folding process, the post-processing apparatus folds the plurality of sheets. There are also known an image forming apparatus forming an image on the sheet, which includes a post-processing mechanism with respect to the sheet on which the image is formed, and an image forming system in which the post-processing apparatus and the image forming apparatus are coupled to each other.

SUMMARY

In an embodiment of the present disclosure, there is provided a post-processing apparatus that includes a first conveyor, a second conveyor, a third conveyor, and a conveyance passage corrector. The first conveyor conveys a sheet conveyed along a first conveyance passage downstream from the first conveyor. The second conveyor conveys the sheet along a second conveyance passage. The third conveyor conveys the sheet along a third conveyance passage. The conveyance passage corrector includes a retracting mechanism to retract from a joining position at which the third conveyance passage joins to the first conveyance passage and turns a conveyance direction of the sheet toward the first conveyor when the sheet enters from the third conveyance passage to the first conveyance passage.

In another embodiment of the present disclosure, there is provided an image forming apparatus that includes an image forming device to form an image onto the sheet and the post-processing apparatus to perform post-processing on the sheet.

In still another embodiment of the present disclosure, there is provided an image forming system that includes the image forming apparatus including an image forming device to form the image onto the sheet and the post-processing apparatus. The image forming apparatus is coupled to the post-processing apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
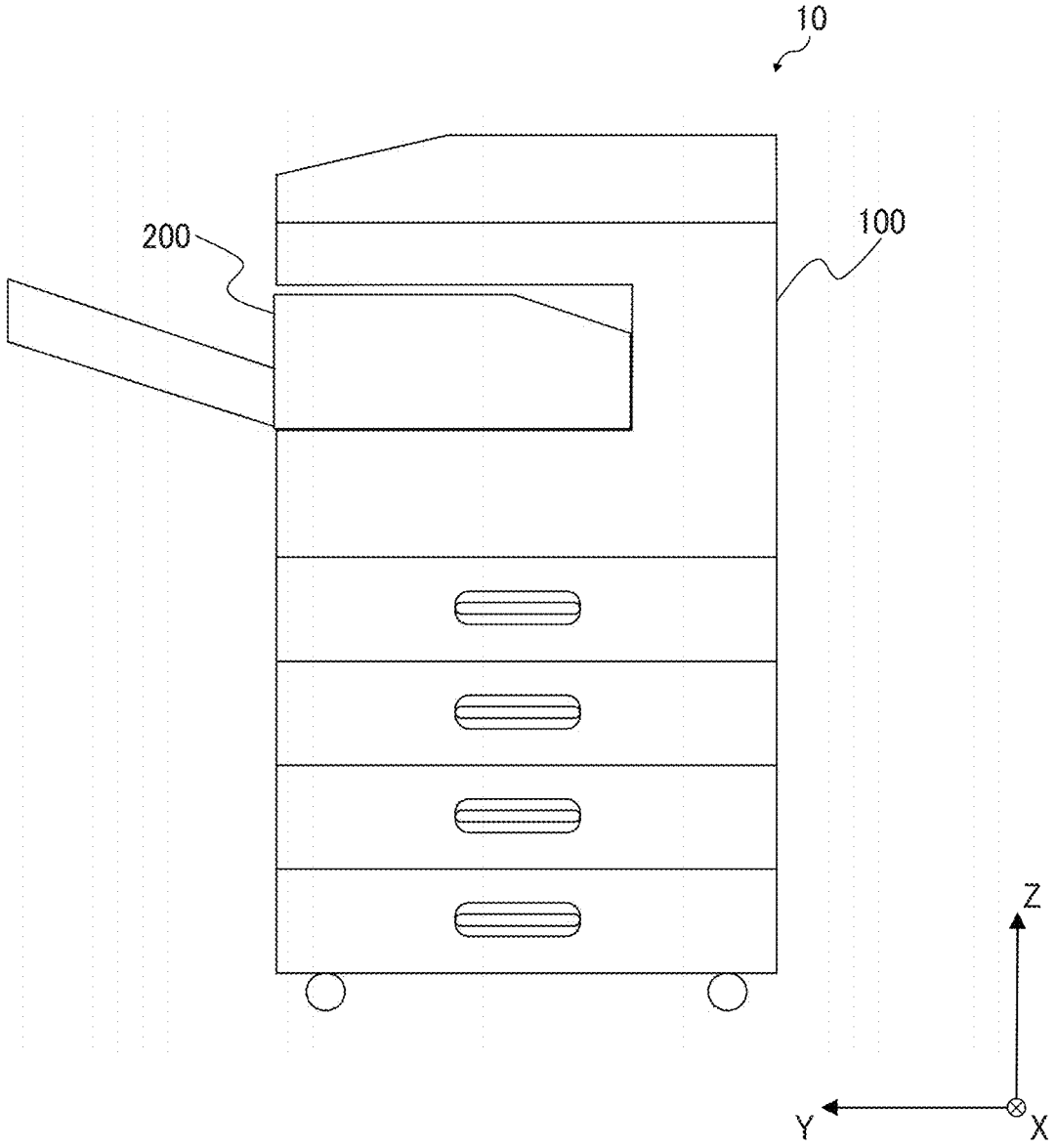
FIG. 1 is a side view of an image forming apparatus including a post-processing apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

First, a description is given of an image forming apparatus according to an embodiment of the present disclosure. FIG. 1 is an external view of a printer 10 serving as the image forming apparatus. The printer 10 includes a printer unit 100 serving as an image forming device, and a folding unit 200 serving as a post-processing apparatus connectable to the printer unit 100. As illustrated in FIG. 1, the printer 10 is an in-body ejection type and has a configuration in which the folding unit 200 is incorporated into a part of the printer unit 100. In the printer 10, the folding unit 200 can be selected as an ejection destination of a recording medium (a sheet P) on which an image is formed. An internal configuration of the folding unit 200 is described later.

Figure 2:
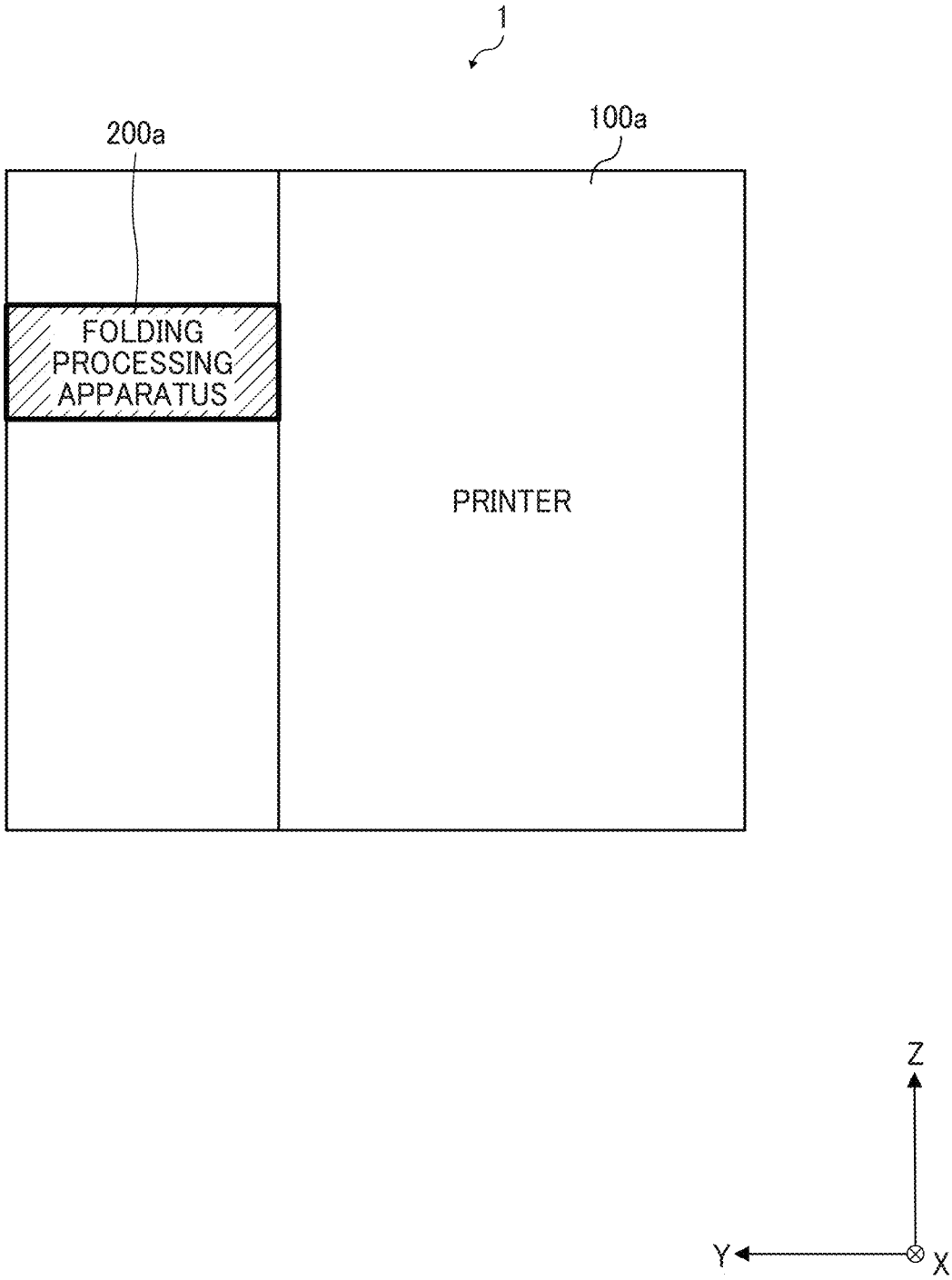
FIG. 2 is a diagram illustrating a configuration of an image forming system according to an embodiment of the present disclosure.

FIG. 2 is a diagram illustrating a configuration of a printer system 1 serving as an image forming system according to an embodiment of the present disclosure. In FIG. 2, the printer system 1 includes a printer 100*a* and a folding processing apparatus 200*a* serving as a post-processing apparatus coupled to each other. The printer system 1 operates such that the sheet P on which an image is formed by the printer 100*a* is conveyed to the folding processing apparatus 200*a* so that a predetermined folding process is performed in the folding processing apparatus 200*a*.

Figure 3:
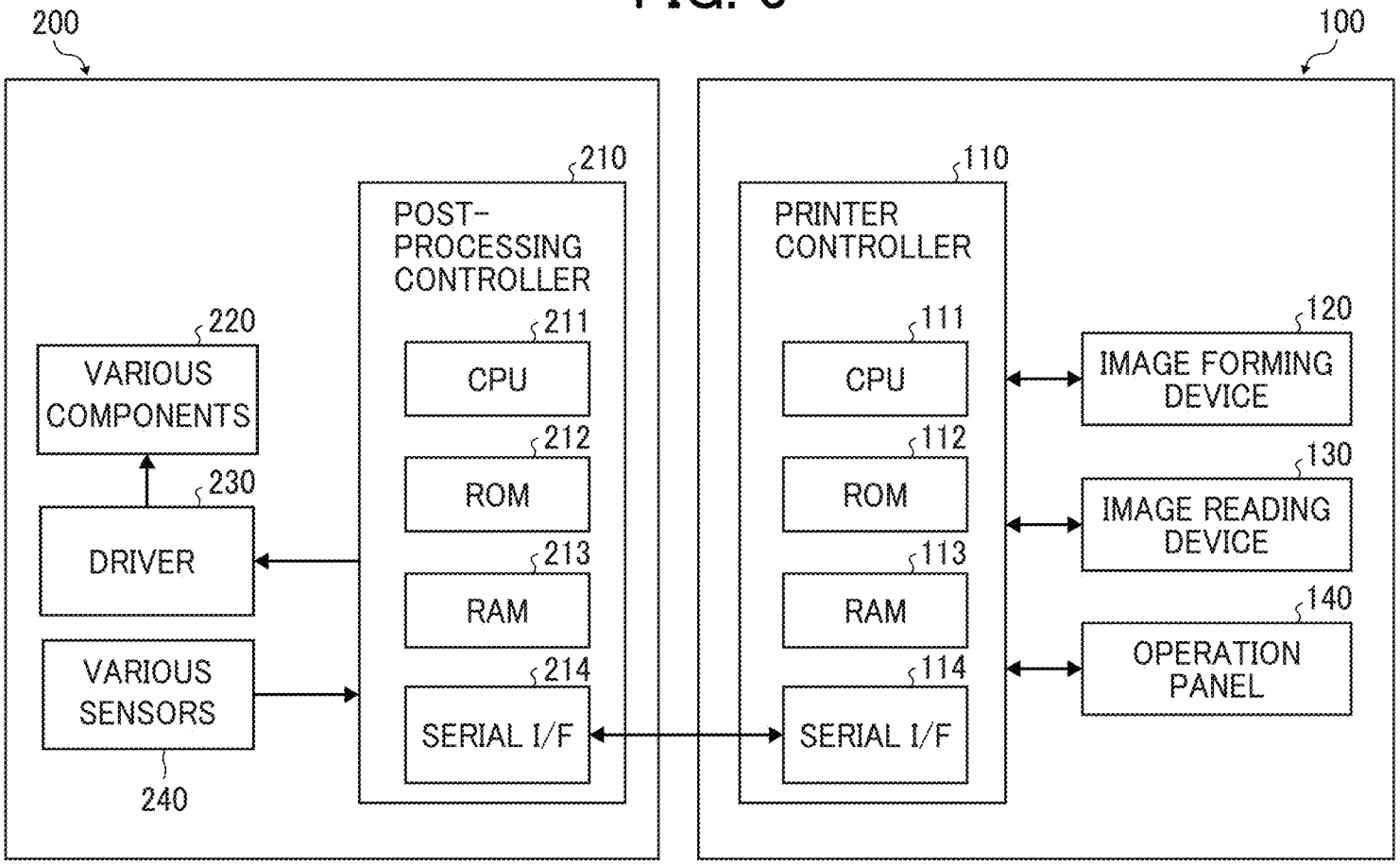
FIG. 3 is a block diagram illustrating a control configuration of the image forming apparatus of FIG. 1.

Next, a description is given of a control block for controlling operations of the printer unit 100 and the folding unit 200 according to the present embodiment with reference to FIG. 3. As illustrated in FIG. 3, the printer unit 100 includes a printer controller 110 serving as the control block. The printer controller 110 includes a central processing unit (CPU) 111, a read only memory (ROM) 112, a random access memory (RAM) 113, and a serial interface (I/F) 114.

The printer controller 110 is connected to an image forming device 120, an image reading device 130, and an operation panel 140. Each of the image forming device 120, the image reading device 130, and the operation panel 140 includes components to perform respective functions. Each component of the image forming device 120, the image reading device 130, and the operation panel 140 operates based on control signals from the printer controller 110.

The image forming device 120 performs an image forming operation based on image data on the sheet P serving as a sheet-shaped recording medium. The image reading device 130 reads an image formed on the sheet P and acquires the image data on the sheet P. The operation panel 140 functions as an input unit to which operation conditions in the image forming device 120 and the image reading device 130 are input and as a display unit that displays, for example, operation results.

A control program for controlling the image forming device 120, the image reading device 130, and the operation panel 140 is stored in the ROM 112. The CPU 111 reads the control program stored in the ROM 112 and expands the control program in the RAM 113. The CPU 111 stores data necessary for control in the RAM 113 and performs the control defined by the control program while using the RAM 113 as a work area.

As illustrated in FIG. 3, the folding unit 200 includes a post-processing controller 210 serving as a control block. The post-processing controller 210 includes a CPU 211, a ROM 212, a RAM 213, and a serial I/F 214.

Various components 220 and various sensors 240 are coupled to the post-processing controller 210. The various components 220 are, for example, rollers and roller pairs described later. The rollers and roller pairs corresponding to the various components 220 function as, for example, sheet conveying roller pairs and sheet folding roller pairs. The various components 220 are driven by a drive motor that drives to rotate the rollers and roller pairs. The post-processing controller 210 instructs a driver 230 to drive the drive motor of the various components 220. The various components 220 perform operations such as conveyance control of the sheet P as the recording medium and the folding process to fold the sheet P.

The various sensors 240 are a plurality of sheet detectors that detect a position of the sheet P in the conveyance passage and are disposed in the conveyance passage described below. The post-processing controller 210 performs processing according to predetermined control programs and, based on detection signals output from the various sensors 240 to the post-processing controller 210, determines the conveyance amount and position of the sheet P to be subjected to the post-processing. The post-processing controller 210 calculates the position of the sheet P, by calculating the conveyance amount (conveyance distance) of the sheet P after the sheet detectors detect a leading end of the sheet P and determine the position of the sheet P, based on the driving amounts of the various components 220.

The control program for the post-processing controller 210 to perform a predetermined processing function is stored in the ROM 212. The CPU 211 reads the control program stored in the ROM 212 and expands the control program in the RAM 213. The CPU 211 stores data necessary for control in the RAM 213, and controls the folding operation defined by the control program while using the RAM 213 as a work area. As described above, the post-processing controller 210 performs the control program stored in the ROM 212 to detect the sheet P and to perform the conveyance control of the sheet P as described below.

The printer controller 110 included in the printer unit 100 and the post-processing controller 210 included in the folding unit 200 are communicably connected to each other via the serial OF 114 and the serial OF 214. This communication passage is used to exchange control commands and information to be used for conveyance control of the recording medium, between the printer controller 110 and the post-processing controller 210. The folding unit 200 determines whether the conveyance control and the folding process are performed on a recording medium and switches the types of the folding process, based on the control commands and information related to the sheet P sent from the printer unit 100, and information related to the position of the recording medium obtained from the various sensors 240.

The printer unit 100 (e.g., the printer controller 110) sends information related to the sheet P to the folding unit 200 (e.g., the post-processing controller 210). The information includes a type and a plurality of pieces of information. For example, the information related to the sheet P includes a plurality of pieces of sheet type information indicating the type, thickness, size, and the like of the sheet P passed from the printer unit 100 to the folding unit 200. Additionally, the information also includes the number of sheets P to be overlaid, the type of folding process performed on the sheet P, and whether an image exists at the folding position in the sheet P. The control commands notified from the printer controller 110 to the post-processing controller 210 include a command notifying whether the delivered sheet P corresponds to the last page (a final sheet) of the unit processed collectively.

Figure 4:
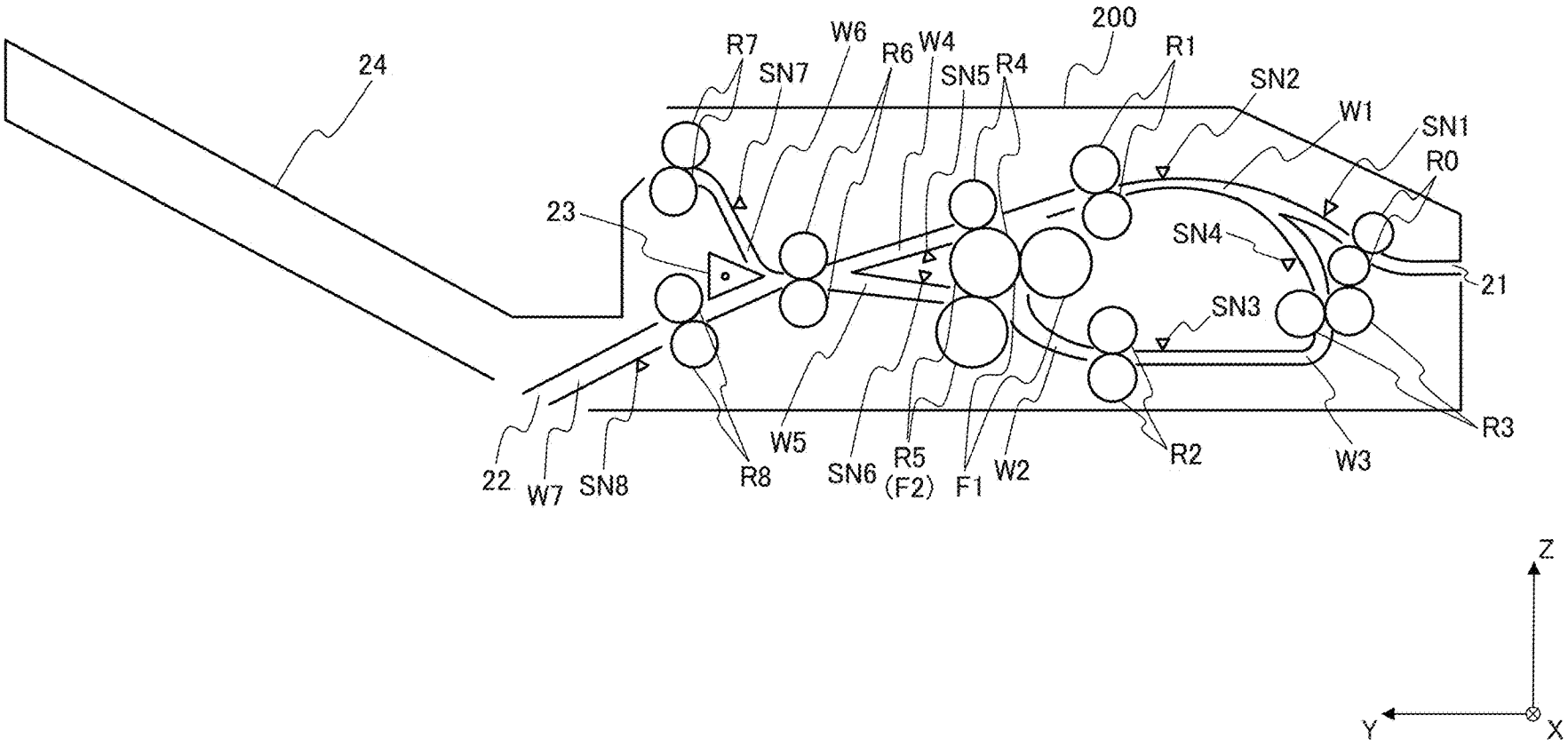
FIG. 4 is a diagram illustrating an internal configuration of a sheet folding apparatus serving as a post-processing apparatus according to an embodiment of the present disclosure.

Next, as the post-processing apparatus according to a first embodiment of the present disclosure, an internal configuration of the folding unit 200 is described. FIG. 4 is a diagram illustrating an internal configuration of the folding unit 200. The folding unit 200 includes a plurality of conveyance passages, a plurality of roller pairs for conveying the sheet P in each conveyance passage and performing the folding process, and a plurality of sheet detection sensors for detecting a conveyance position of the sheet P. Each of the plurality of roller pairs functions as a conveyor or a folder.

The plurality of conveyance passages of the folding unit 200 include roughly seven conveyance passages. As illustrated in FIG. 4, the seven conveyance passages include a first conveyance passage W1, a second conveyance passage W2, a third conveyance passage W3, a fourth conveyance passage W4, a fifth conveyance passage W5, a sixth conveyance passage W6, and a seventh conveyance passage W7.

A plurality of roller pairs is disposed along each of the first conveyance passage W1, the second conveyance passage W2, the third conveyance passage W3, the fourth conveyance passage W4, the fifth conveyance passage W5, and the sixth conveyance passage W6. Each of the plurality of roller pairs is disposed in each of the conveyance passages to convey the sheet P and functions as a zeroth conveyor R0, a first conveyor R1, a second conveyor R2, a third conveyor R3, a fourth conveyor R4, a fifth conveyor R5, and a sixth conveyor R6. The post-processing controller 210 perform a control program to control start and stop of rotation of each conveying roller pair serving as a conveyor. The control performs start and stop of the conveyance of the sheet P.

The folding unit 200 includes a plurality of conveyance branching members. The plurality of conveyance branching members switches, for example, the state of the conveyance passages between a state in which the sheet P is conveyed from the first conveyance passage W1 to the second conveyance passage W2 and a state in which the sheet P conveyed to the second conveyance passage W2 is conveyed in a direction to return to the first conveyance passage W1. The conveyance branching members also switch the state of the conveyance passages to a state in which the sheet is conveyed to the third conveyance passage W3 while returning from the second conveyance passage W2 to the first conveyance passage W1, thereby circulating the sheet P in a circulation conveyance passage.

The conveyance branching members further switch the state of the conveyance passages to convey the sheet P to the fourth conveyance passage W4 downstream from the second conveyance passage W2 without conveying the sheet P to the circulation conveyance passage.

The conveyance branching members furthermore switch the state of the conveyance passages to convey the sheet P from the first conveyance passage W1 to the fifth conveyance passage W5 downstream from the second conveyance passage W2 via the third conveyance passage W3. The plurality of conveyance branching members are arranged in the folding unit 200 to perform switching the conveyance passages.

For example, as illustrated in FIGS. 5 to 14, the plurality of conveyance branching members include a first conveyance branching member J1, a second conveyance branching member J2, and a third conveyance branching member J3. The plurality of conveyance branching members are included in the various components 220 of which the operations are controlled by the post-processing controller 210. The post-processing controller 210 controls operations of the plurality of conveyance branching members to control the conveyance passages of the sheet P. Note that the folding unit 200 includes a first folder F1 and a second folder F2 to perform the folding process of the sheet P in the circulation conveyance passage.

The folding unit 200 includes the zeroth conveyor R0 serving as an entrance conveying roller pair. The zeroth conveyor R0 is disposed in the vicinity of an entrance 21 that receives the sheet P from the printer unit 100. After the post-processing controller 210 has received the information indicating that the sheet P has been ejected from the printer unit 100, the post-processing controller 210 controls the drive motor that rotationally drives the zeroth conveyor R0 to start driving. Subsequently, when the leading end of the sheet P reaches the nip of the roller pair of the zeroth conveyor R0, the zeroth conveyor R0 conveys the sheet P downstream from the zeroth conveyor R0 in the conveyance direction.

As described below, the folding unit 200 receives the next sheet P before ejecting the sheet P carried in from the printer unit 100 from an exit 22 on the downstream side. Thus, the folding unit 200 performs a conveyance process and a folding process in which a preceding sheet P and a subsequent sheet P are overlaid. In the following description, the sheet P received from the printer unit 100 in the above description, in other words, a preceding sheet is referred to as a "preceding sheet P1" for the sake of description. A sheet P subsequent to the preceding sheet P1 and received by the folding unit 200 after the preceding sheet P1 is referred to as a "subsequent sheet P2". The sheet P which is received by the folding unit 200 subsequent to the subsequent sheet P2 and is subjected to an overlaying process is referred to as "next sheet P3". A plurality of sheets obtained by overlaying the plurality of sheets P is referred to as a "sheet bundle Q".

Note that the maximum number of sheets P in the overlaying process or the folding process in the folding unit 200 is not limited to three, and four more sheets may be processed.

The first conveyor R1 includes a roller pair facing each other across the first conveyance passage W1, and a nip is formed between the roller pair. The first folder F1 includes a roller pair facing each other and being disposed between the first conveyance passage W1 and the second conveyance passage W2, and a nip is formed between the roller pair. The passage guided by the nip in the first folder F1 guides the preceding sheet P1 from the first conveyance passage W1 to the second conveyance passage W2.

The preceding sheet P1 guided to the second conveyance passage W2 is conveyed to the third conveyance passage W3 by the third conveyor R3. Subsequently, the third conveyor R3 temporarily stops the conveyance of the preceding sheet P1 in the third conveyance passage W3. The preceding sheet P1 temporarily stopped in the third conveyance passage W3 is restarted when the subsequent sheet P2 is received from the printer unit 100. As a result, the preceding sheet P1 returns to a portion upstream from the first conveyor R1 in the first conveyance passage W1 and joins the subsequent sheet P2. The circulation conveyance passage is formed as described above.

In the circulation conveyance passage described above, the preceding sheet P1 and the subsequent sheet P2 are overlaid to form the sheet bundle Q. The following describes the folding process performed on the sheet bundle Q.

The post-processing controller 210 controls the first folder F1 to perform the folding process on the sheet bundle Q. The sheet bundle Q folded by the first folder F1 is delivered from the second conveyance passage W2 to the fifth conveyance passage W5. The fourth conveyor R4, the fifth conveyor R5, and the first folder F1 are driven by the same drive motor. The drive motor is rotatable in both of a forward direction and a reverse direction. By changing the direction of rotation, the post-processing controller 210 causes the drive motor to convey the sheet bundle Q in which the preceding sheet P1 and the subsequent sheet P2 are overlaid and to perform the folding process.

A branching claw 23 is disposed immediately after the sixth conveyor R6. The branching claw 23 switches a guide position between a position at which the branching claw 23 guides the sheet P (or the sheet bundle Q) to the sixth conveyance passage W6 and a position at which the branching claw 23 guides the sheet P (or the sheet bundle Q) to the seventh conveyance passage W7. The branching claw 23 may be driven by, for example, a solenoid to switch the guide position. Note that the solenoid may be replaced by a driving mechanism including, for example, a motor, a gear, and a cam.

The sheets P passed through the fourth conveyance passage W4 or the fifth conveyance passage W5 are ejected and stacked on an output tray 24 of the folding unit 200. The seventh conveyance passage W7 is a passage for delivering the sheet P to a post-processing apparatus in a case in which the post-processing apparatus is disposed downstream from the folding unit 200 as an image forming system. The post-processing apparatus performs post-processing such as an alignment process or a binding process on a folded sheet P or a non-folded sheet P.

A first sheet detection sensor SN1 is disposed immediately after the zeroth conveyor R0 of the first conveyance passage W1. A second sheet detection sensor SN2 is disposed immediately before the first conveyor R1. A third sheet detection sensor SN3 is disposed immediately after the second conveyor R2 in the third conveyance passage W3. A fourth sheet detection sensor SN4 is disposed immediately after the third conveyor R3 in the third conveyance passage W3. A fifth sheet detection sensor SN5 is disposed immediately after the fourth conveyor R4 in the fourth conveyance passage W4. A sixth sheet detection sensor SN6 is disposed immediately after the fifth conveyor R5 in the fifth conveyance passage W5. A seventh sheet detection sensor SN7 is disposed immediately after the sixth conveyor R6 in the sixth conveyance passage W6.

The folding unit 200 illustrated in FIG. 4 can perform inward three folding and outward three folding in a state in which the sheets P are overlaid. FIGS. 5 to 10 illustrate a series of operations for generating the sheet bundle Q by overlaying two sheets P via the circulation conveyance passage.

Figure 5:
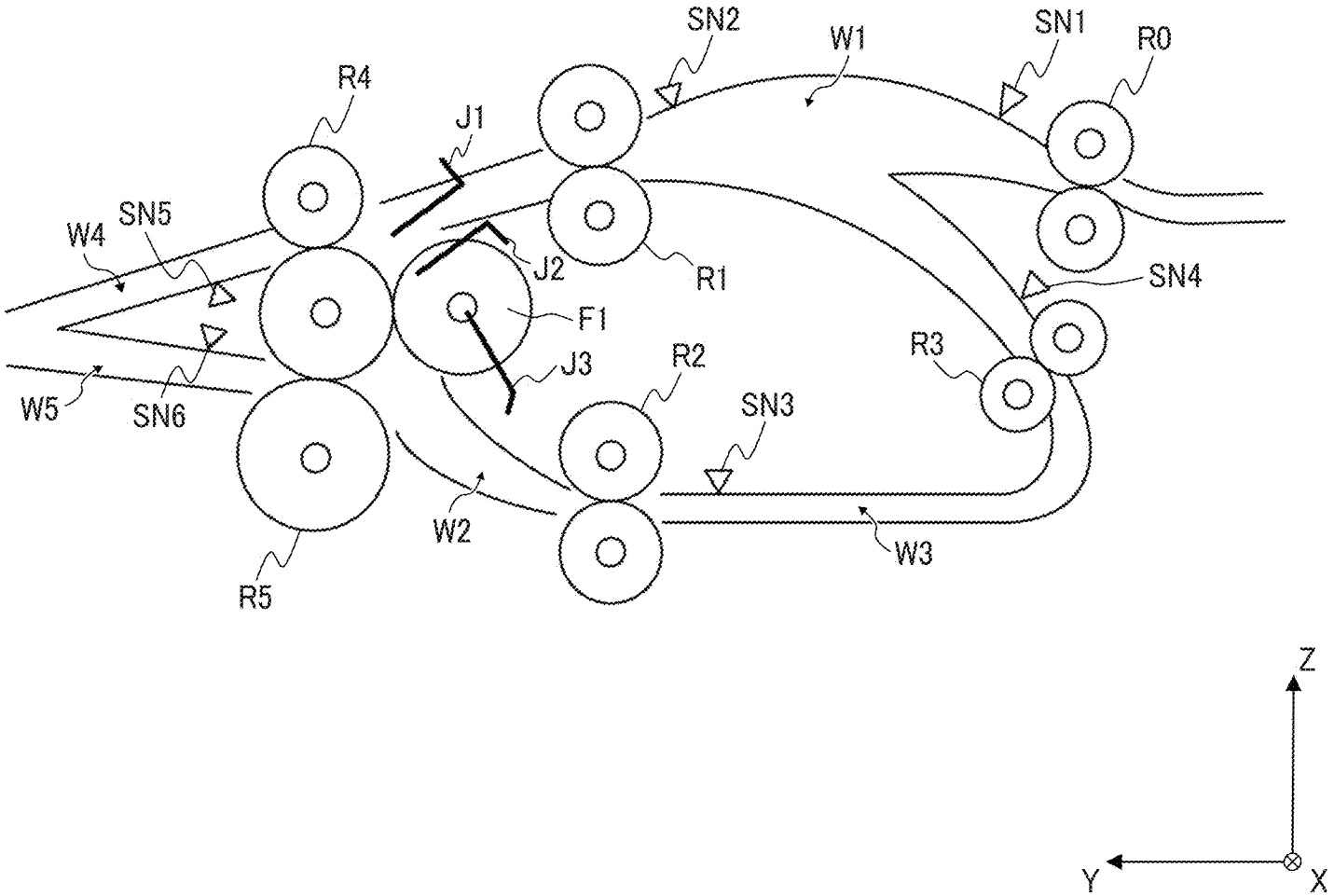
FIG. 5 is an enlarged view of an internal configuration of the sheet folding apparatus in FIG. 4, illustrating one step of a folding and conveying operation.

FIG. 5 illustrates an initial state before the sheet P is conveyed from the printer unit 100. In the state illustrated in FIG. 5, when a leading end of the preceding sheet P1 conveyed from the printer unit 100 reaches an output port of the printer unit 100, the post-processing controller 210 controls the zeroth conveyor R0 to rotate.

Figure 6:
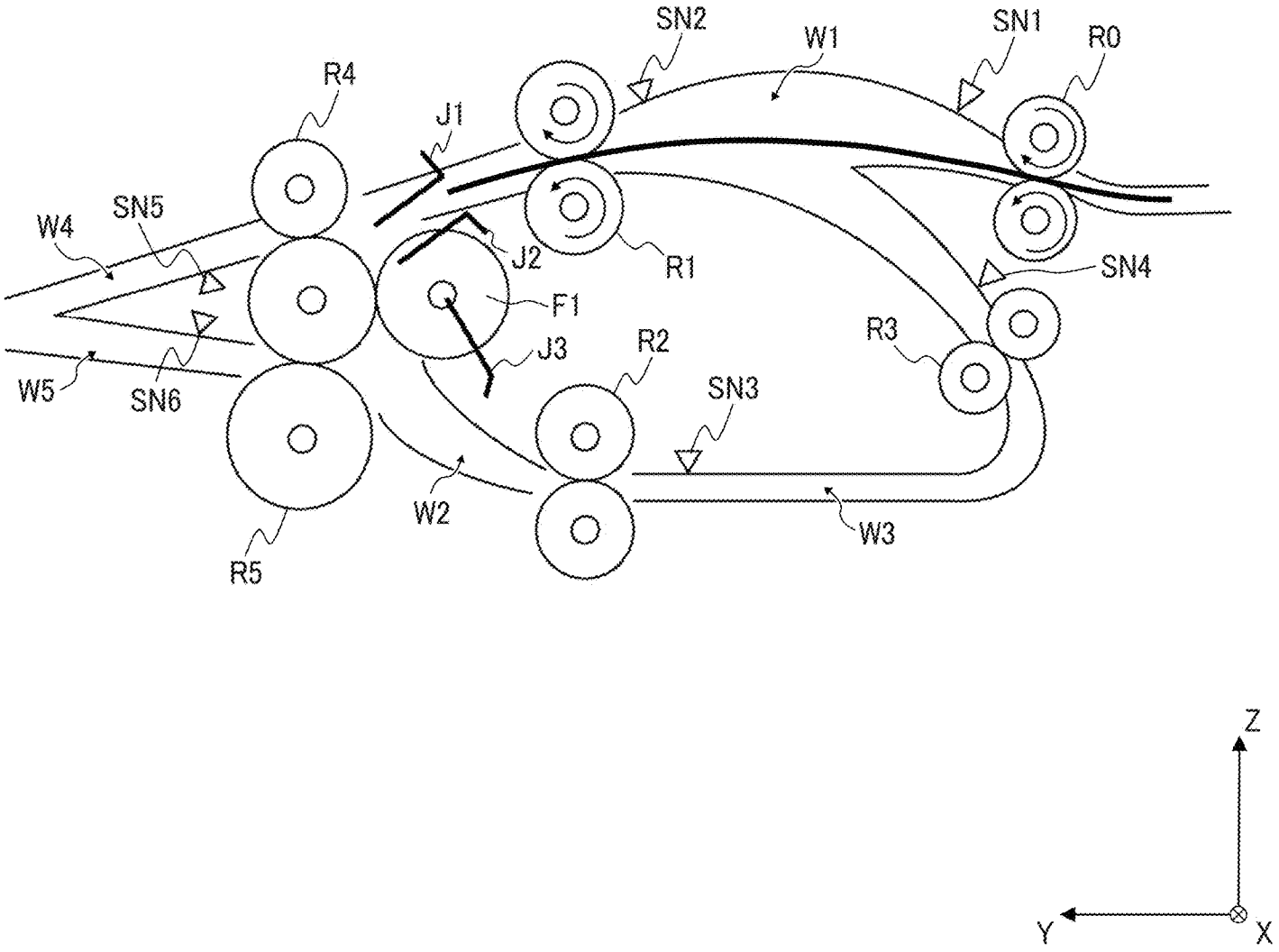
FIG. 6 is an enlarged view of an internal configuration of the sheet folding apparatus, illustrating one step of the folding and conveying operation subsequent to the state in FIG. 5.

As illustrated in FIG. 6, the preceding sheet P1 is conveyed to the first conveyance passage W1 by the rotation of the zeroth conveyor R0. In order to convey the preceding sheet P1 not to the fourth conveyance passage W4 but to the second conveyance passage W2 and guide the preceding sheet P1 to the circulation conveyance passage, the post-processing controller 210 causes a driver to move the first conveyance branching member J1 to the position illustrated in FIG. 6.

When the leading end of the preceding sheet P1 conveyed by the zeroth conveyor R0 is detected by the first sheet detection sensor SN1, a detection signal is notified to the post-processing controller 210. After receiving the detection signal, the post-processing controller 210 calculates a timing at which a protrusion amount of the leading end of the sheet P reaches a predetermined value from the nip position of the first conveyor R1. The protrusion amount of the leading end of the sheet P from the nip position of the first conveyor R1 is referred to as a "first protrusion amount Δl". At the timing of reaching the first protrusion amount 41, the first conveyor R1 starts to rotate.

When the leading end of the preceding sheet P1 enters the nip of the first conveyor R1, the post-processing controller 210 rotates the first folder F1, the second conveyor R2, and the third conveyor R3.

Figure 7:
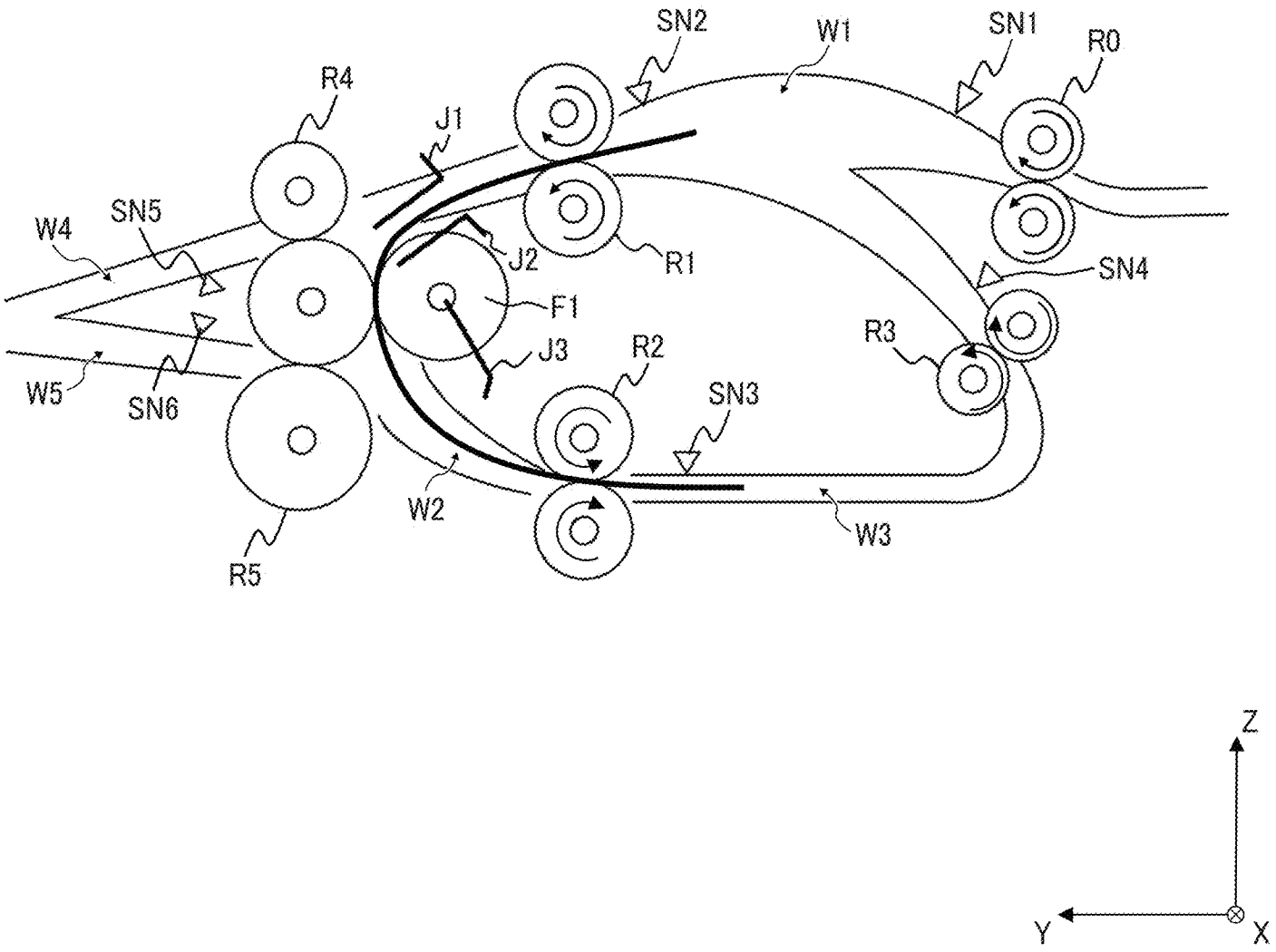
FIG. 7 is an enlarged view of an internal configuration of the sheet folding apparatus, illustrating one step of the folding and conveying operation subsequent to the state in FIG. 6.

As illustrated in FIG. 7, the preceding sheet P1 is conveyed to the second conveyance passage W2 by the operation of the first conveyor R1, is conveyed to the second conveyor R2 along the downward slope of the second conveyance passage W2, and is conveyed to the third conveyance passage W3 by the operation of the second conveyor R2. When the leading end of the preceding sheet P1 is detected by the fourth sheet detection sensor SN4, a detection signal from the fourth sheet detection sensor SN4 is notified to the post-processing controller 210. After receiving the detection signal, the post-processing controller 210 calculates the timing at which the preceding sheet P1 is conveyed, and the leading end thereof reaches a position corresponding to a second protrusion amount 42 from the position of the fourth sheet detection sensor SN4.

Figure 8:
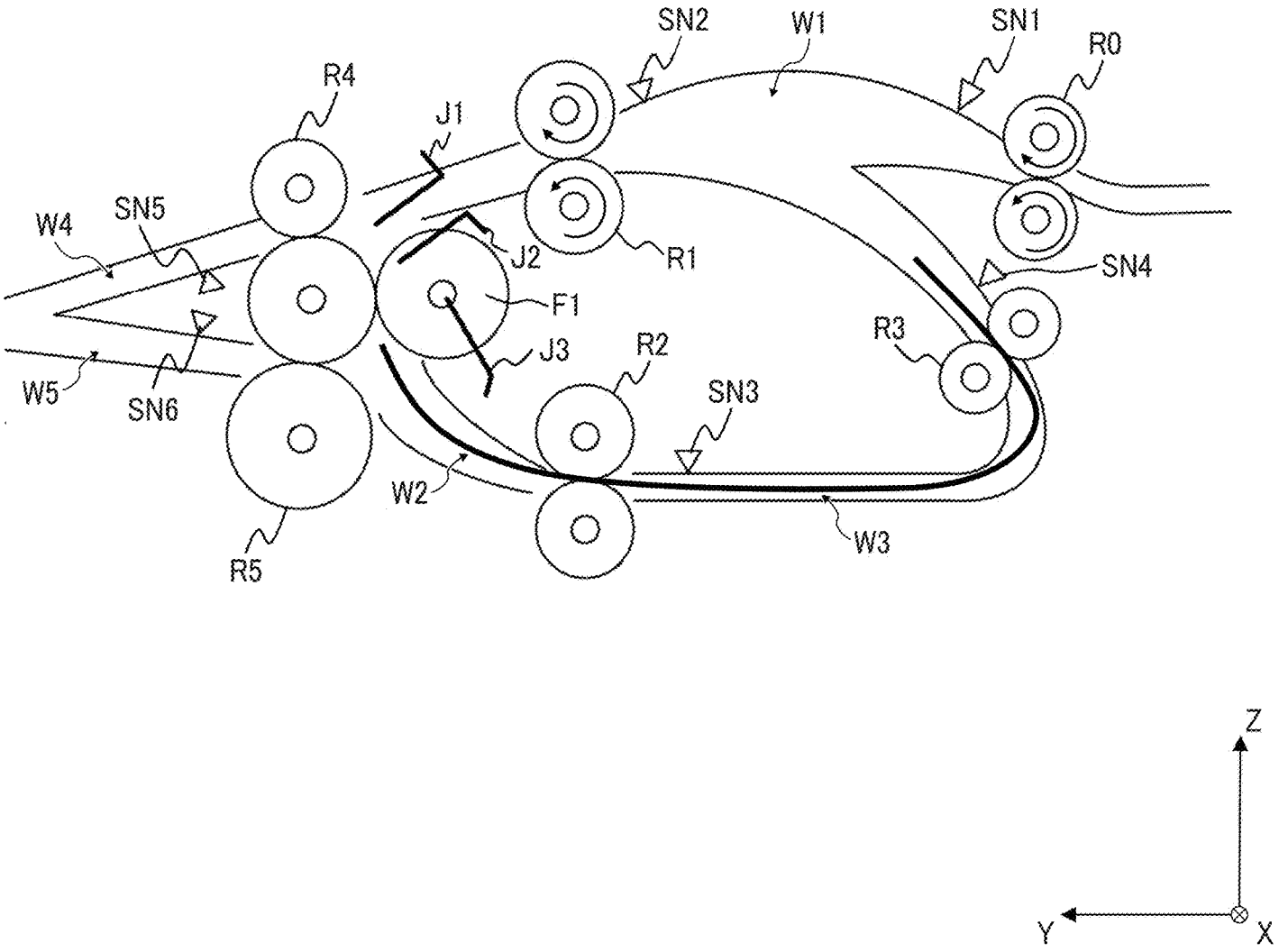
FIG. 8 is an enlarged view of an internal configuration of the sheet folding apparatus, illustrating one step of the folding and conveying operation subsequent to the state in FIG. 7.

As illustrated in FIG. 8, when the post-processing controller 210 determines that the leading end of the preceding sheet P1 reaches the position corresponding to the second protrusion amount 42, the post-processing controller 210 stops the rotation of the first folder F1, the second conveyor R2, and the third conveyor R3 to stop the conveyance of the preceding sheet P1.

Even when the conveyance of the preceding sheet P1 is stopped, the rotation of the first conveyor R1 is continued in order to receive the subsequent sheet P2 conveyed after the preceding sheet P1 from the printer unit 100.

Figure 9:
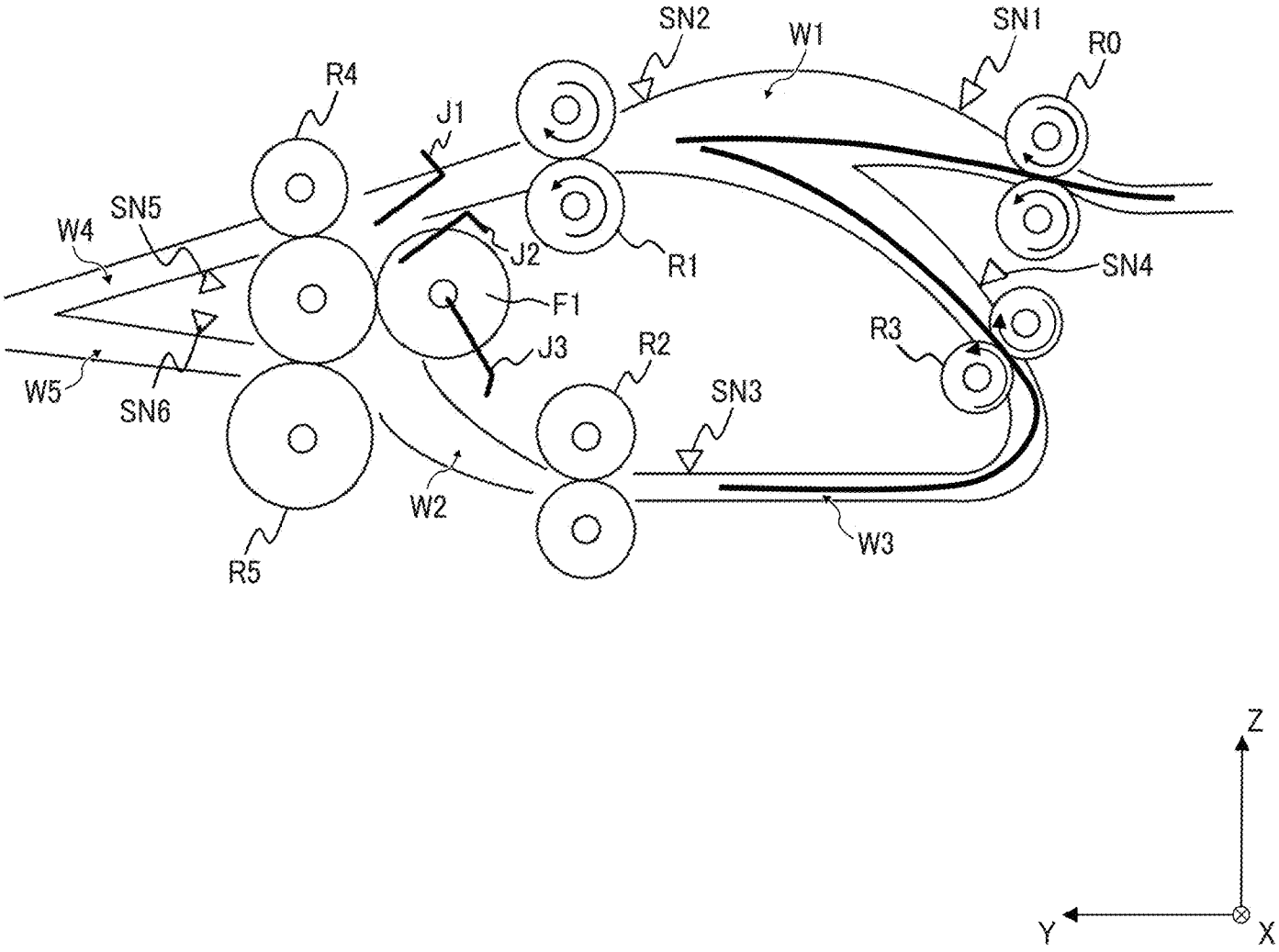
FIG. 9 is an enlarged view of an internal configuration of the sheet folding apparatus, illustrating one step of the folding and conveying operation subsequent to the state in FIG. 8.

As illustrated in FIG. 9, after the detection signal indicating that the leading end of the subsequent sheet P2 is detected by the first sheet detection sensor SN1 is notified, the post-processing controller 210 resumes conveyance of the preceding sheet P1 at the timing calculated from the detection of the first sheet detection sensor SN1 while conveying the subsequent sheet P2, and conveys the preceding sheet P1 and the subsequent sheet P2 overlaid on one another in a state in which the subsequent sheet P2 slightly precedes the preceding sheet P1. This timing corresponds to a timing until the subsequent sheet P2 reaches a position corresponding to a third protrusion amount 43 when the leading end of the subsequent sheet P2 joins the preceding sheet P1. When the leading end of the subsequent sheet P2 reaches the position corresponding to the third protrusion amount 43, the post-processing controller 210 resumes the rotation of the second conveyor R2 and the third conveyor R3. As a result, as illustrated in FIG. 9, the conveyance of the preceding sheet P1 which has been stopped is resumed.

In other words, the "timing" is calculated from the detection result of the first sheet detection sensor SN1 while conveying the subsequent sheet P2 without stopping the subsequent sheet P2. The conveyance of the preceding sheet P1 is resumed at the calculated timing. By this control, the subsequent sheet P2 is conveyed while being overlaid on the preceding sheet P1 in a state slightly preceding the preceding sheet P1.

The post-processing controller 210 calculates the third protrusion amount 43 based on a motor speed of the zeroth conveyor R0, a motor speed of the third conveyor R3, distances between the first sheet detection sensor SN1, the second sheet detection sensor SN2, and the fourth sheet detection sensor SN4. The third protrusion amount 43 defines a shift amount between the leading ends of the preceding sheet P1 and the subsequent sheet P2 to make the leading ends of the preceding sheet P1 and the subsequent sheet P2 join each other before reaching the first conveyor R1.

Figure 10:
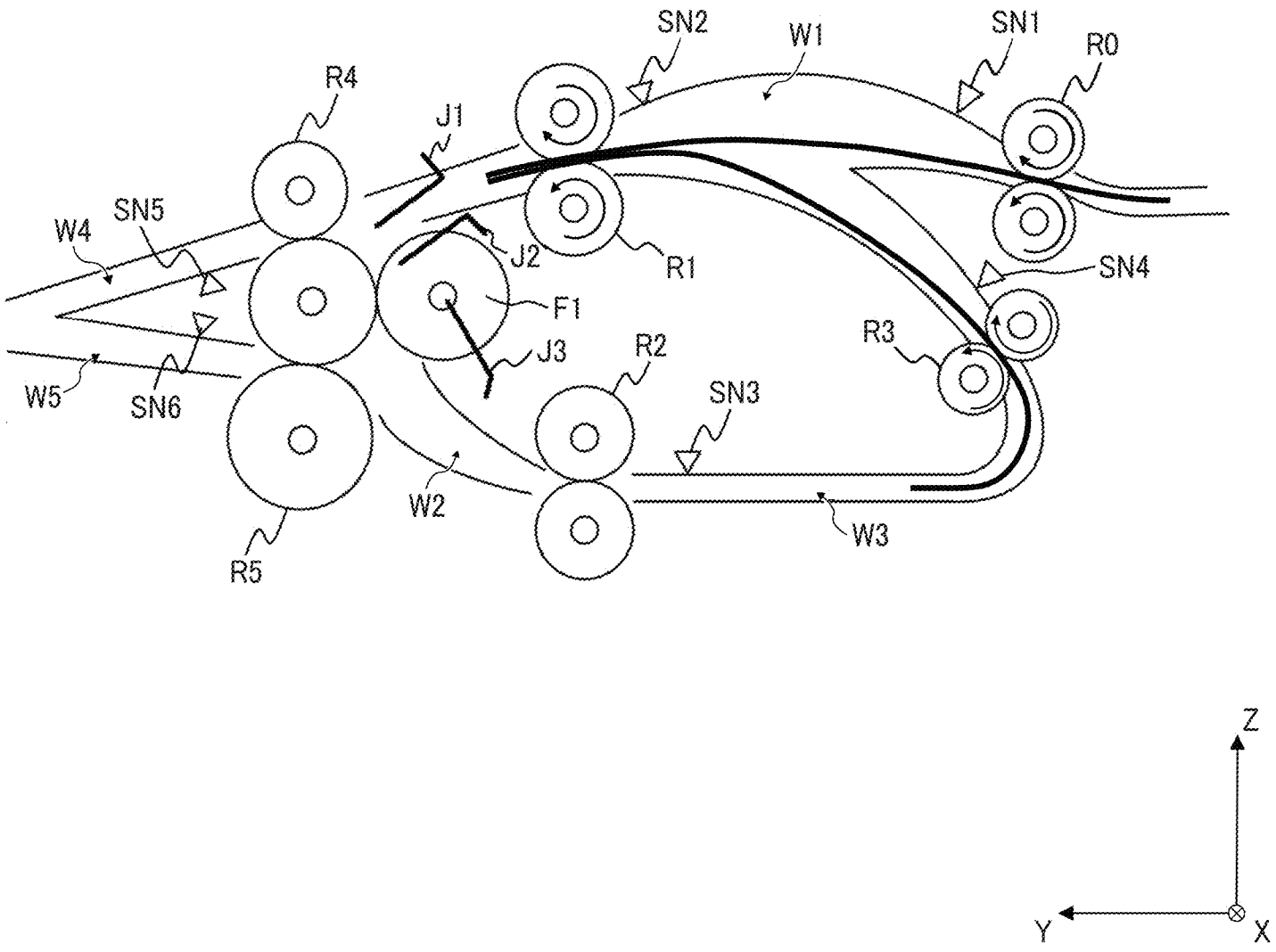
FIG. 10 is an enlarged view of an internal configuration of the sheet folding apparatus, illustrating one step of the folding and conveying operation subsequent to the state in FIG. 9.

The leading end of the preceding sheet P1 and the leading end of the subsequent sheet P2 join each other to generate the sheet bundle Q. Thus, as illustrated in FIG. 10, the sheet bundle Q passes through the nip of the first conveyor R1 and is conveyed downstream from the nip. As described above, the post-processing controller 210 controls such that the subsequent sheet P2 first abuts against the nip of the first conveyor R1, and after that, the preceding sheet P1 abuts against the nip of the first conveyor R1. As a result, when the third protrusion amount 43 is large, the joining timing can be adjusted even in a case in which joining has not yet occurred before the second sheet detection sensor SN2.

After that, the post-processing controller 210 determines whether a number of sheets to be folded notified by the printer unit 100 coincides a number of sheets received by the folding unit 200. When the number of sheets to be folded coincides the number of sheets received by the folding unit 200, the post-processing controller 210 performs the folding process described below. If the above-described numbers do not coincide with each other, the processing illustrated in FIGS. 7 to 9 is performed again. The next sheet P3 (the sheet P next to the subsequent sheet P2) conveyed from the printer unit 100 and the sheet bundle Q are joined and overlaid. Note that the post-processing controller 210 can determine whether the sheet P is conveyed to a position immediately before the nip of the second conveyor R2 based on, for example, the number of drive steps of the drive motor that drives the first conveyor R1. Accordingly, a stepping motor may be used as the drive motor to rotationally drive each conveyor. Note that, if the drive is controlled based on the timing calculated by detection of each sensor, a direct current (DC) motor can also be applied.

Next, a procedure of the folding process in the folding unit 200 according to the present embodiment is described. FIGS. 11 to 14 illustrate the outward three folding performed on the sheet bundle Q received from upstream in a conveyance direction.

As described with reference to FIG. 10, the sheet bundle Q, in which the preceding sheet P1 joins the subsequent sheet P2, is conveyed by the zeroth conveyor R0 and the first conveyor R1 as it is. When a leading end of the sheet bundle Q enters the nip of the first conveyor R1, the sheet bundle Q is conveyed to the fourth conveyor R4.

Figure 11:
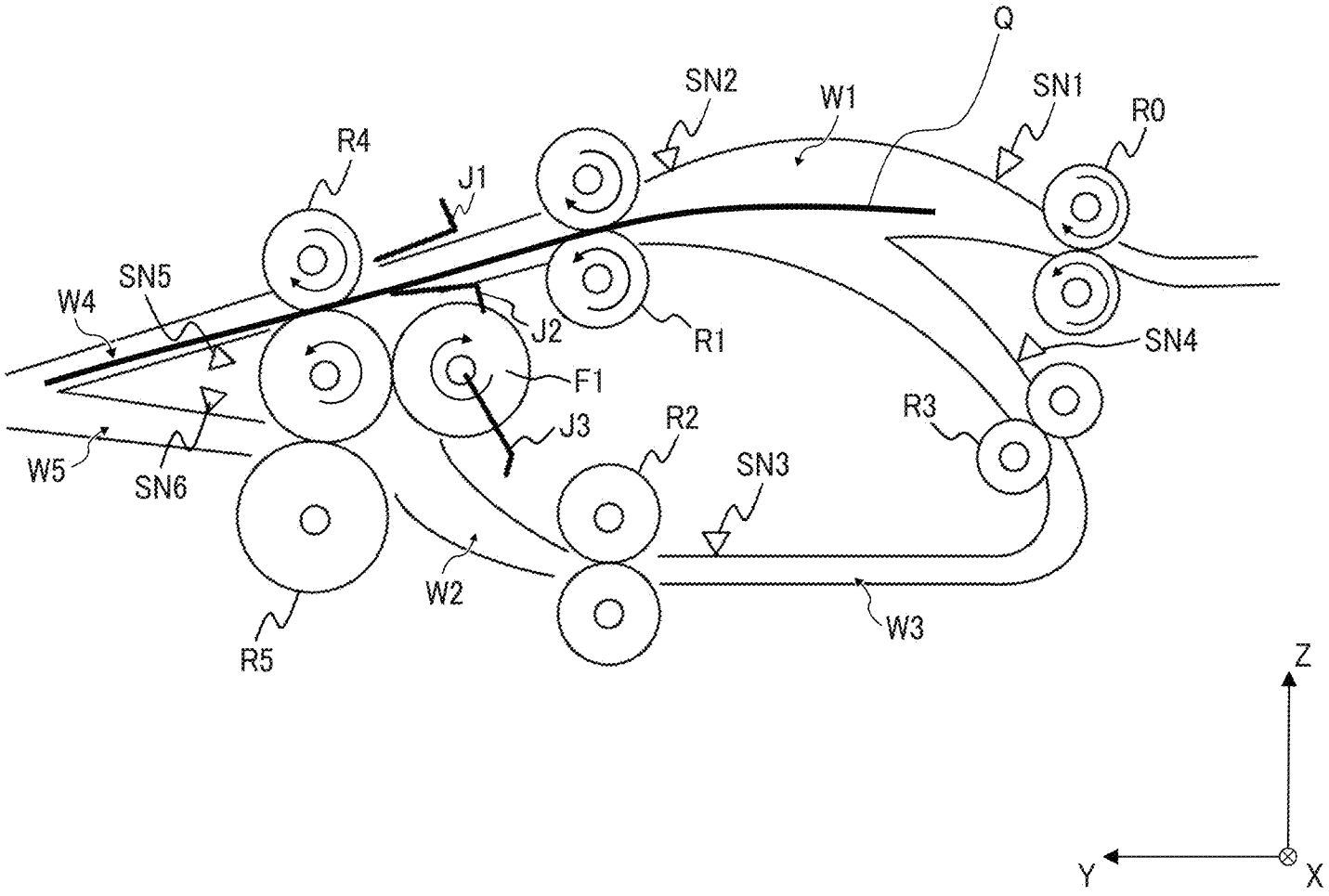
FIG. 11 is an enlarged view of an internal configuration of the sheet folding apparatus, illustrating one step of the folding and conveying operation subsequent to the state in FIG. 10.

When the first conveyor R1 conveys the sheet bundle Q to a position immediately before the nip of the fourth conveyor R4, the post-processing controller 210 drives the drive motor to rotate the fourth conveyor R4 in the direction indicated by arc arrows in FIG. 11 in addition to the first conveyor R1 rotated in the direction indicated by the arc arrows in FIG. 11. The leading end of the sheet bundle Q is conveyed from the position detected by the fifth sheet detection sensor SN5 until the leading end of the sheet bundle Q reaches a fourth protrusion amount Δ4.

Figure 12:
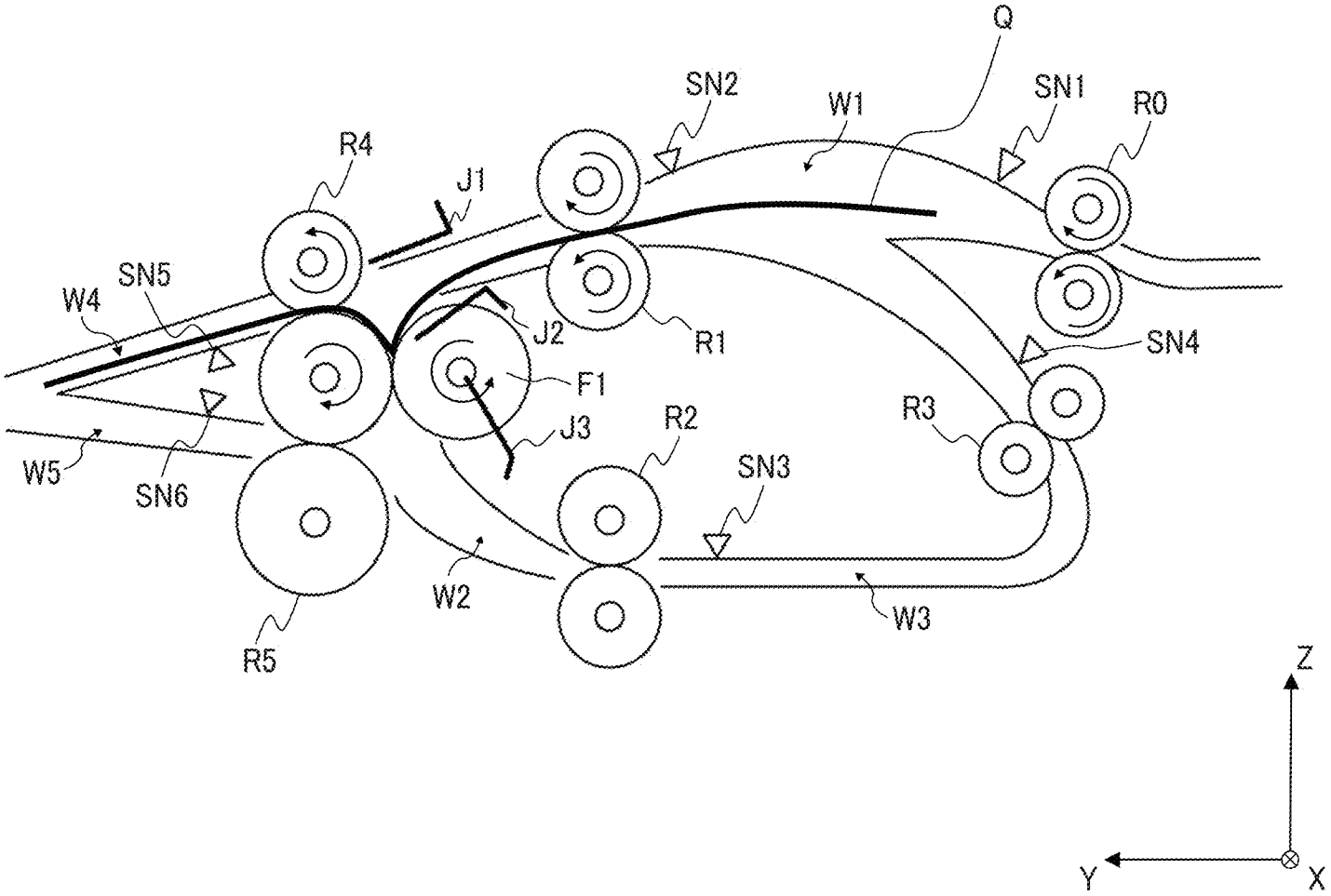
FIG. 12 is an enlarged view of an internal configuration of the sheet folding apparatus, illustrating one step of the folding and conveying operation subsequent to the state in FIG. 11.

After that, the post-processing controller 210 reversely rotates the fourth conveyor R4 (first folder F1) to convey the sheet bundle Q in a direction opposite to the conveyance direction illustrated in FIG. 7 while rotating the first conveyor R1 in the conveyance direction (see FIG. 12). The above-described reverse rotation of the fourth conveyor R4 conveys the sheet bundle Q in the direction opposite the conveyance direction.

Figure 13:
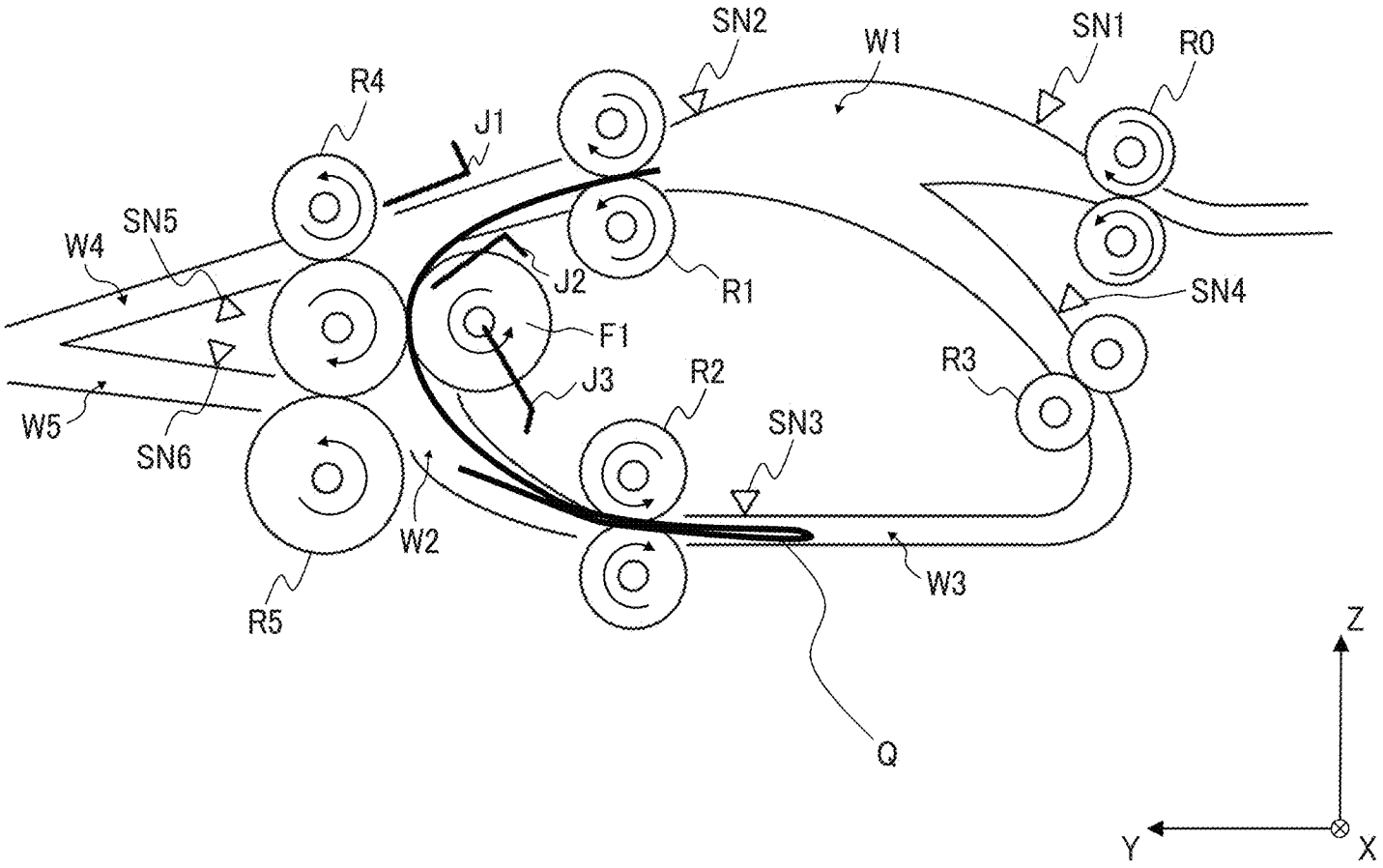
FIG. 13 is an enlarged view of an internal configuration illustrating one step of the folding and conveying operation in the sheet folding apparatus, subsequent to the state in FIG. 12.

On the other hand, as illustrated in FIG. 13, the first conveyor R1 rotates in the direction continuous from the state illustrated in FIG. 9 to convey the sheet bundle Q in the conveyance direction. As a result, a bend is formed on the sheet bundle Q before the nip of the first folder F1. The bend enters the nip, and the first folder F1 performs a first folding, thereby forming a first crease.

The sheet bundle Q on which the first folding is performed is conveyed to the second conveyance passage W2, is conveyed along the downward slope of the second conveyance passage W2 and is conveyed from the point where the leading end of the sheet bundle Q is detected by the third sheet detection sensor SN3 until the leading end of the sheet P corresponds to a fifth protrusion amount Δ5.

Figure 14:
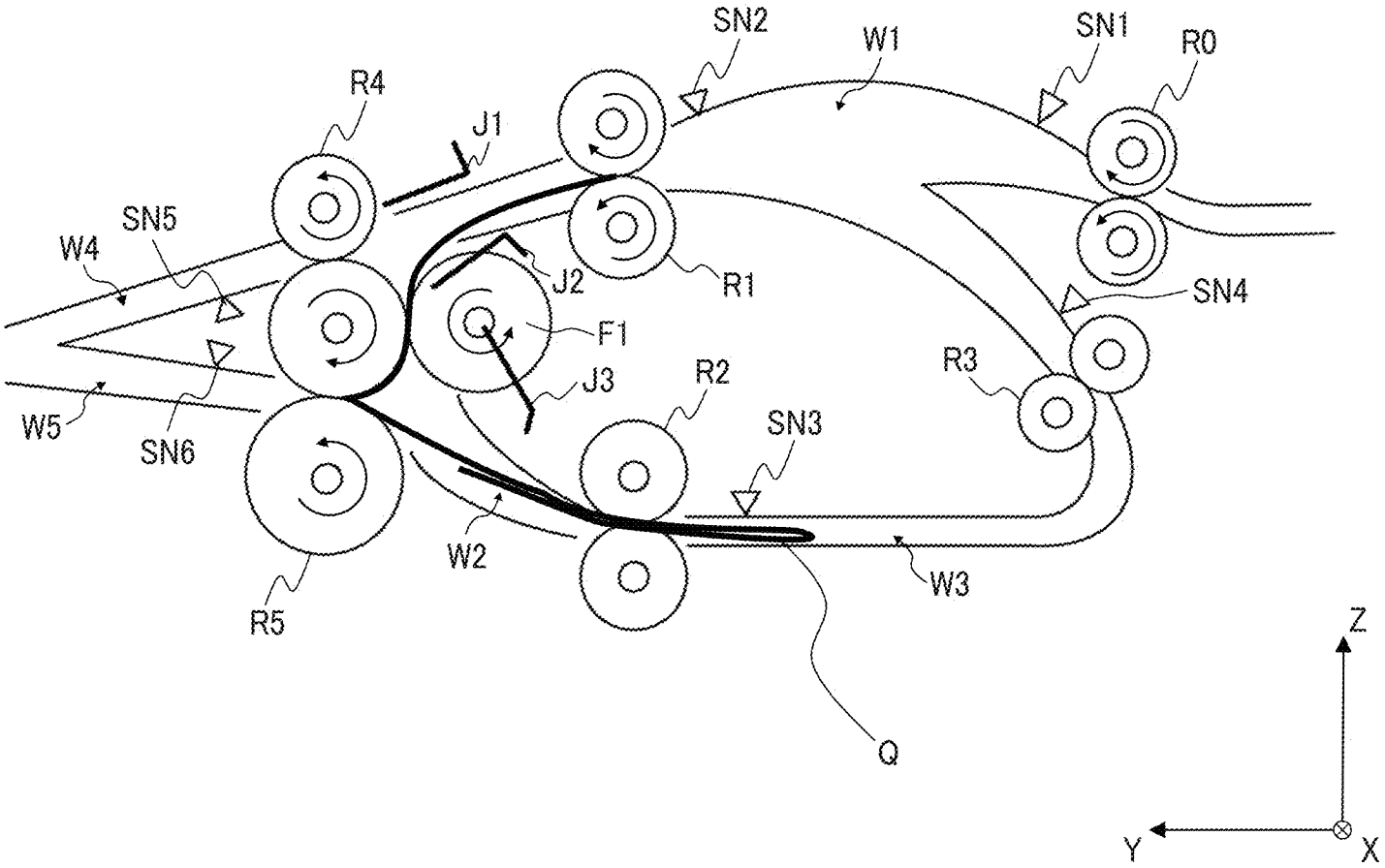
FIG. 14 is an enlarged view of an internal configuration of the sheet folding apparatus, illustrating one step of the folding and conveying operation subsequent to the state in FIG. 13.

After that, the post-processing controller 210 rotates the second conveyor R2 in a direction opposite to the rotation direction illustrated in FIG. 13 while rotating the fourth conveyor R4 (first folder F1) in the conveyance direction. The above-described reverse rotation of the second conveyor R2 conveys the sheet P in the reverse direction from the second conveyor R2. In addition, the post-processing controller 210 rotates the fourth conveyor R4 (first folder F1) in the direction continuous from the state illustrated in FIG. 13 to convey the sheet P. As a result, as illustrated in FIG. 14, a bend is formed before the nip of the fifth conveyor R5 (second folder F2). The bend enters the nip, and the second folder F2 performs a second folding, thereby forming a second crease.

The sheet bundle Q on which the second folding is performed passes through the fifth conveyance passage W5 and is conveyed to the output tray 24. The fourth protrusion amount Δ4 and the fifth protrusion amount Δ5 are determined based on the total length of the sheet P and a folding way set for the sheet P (or the sheet bundle Q). Based on this setting, the post-processing controller 210 determines the fourth protrusion amount Δ4 and the fifth protrusion amount Δ5 by the rotation amount (the number of drive steps of the drive motor) of the second conveyor R2.

In the case of the outward three folding, the first folding is performed at a position corresponding to one third of the entire length of the sheet P from the leading end of the sheet P in the conveyance direction. The second folding is performed at a position corresponding to one third on the opposite side of the entire length of the sheet P. In the case of the inward three folding, the first folding is performed at a position corresponding to two third of the entire length of the sheet P from the leading end of the sheet P in the conveyance direction of the sheet P, and the second folding is performed at a position corresponding to one third on the opposite side of the entire length.

After that, the fifth conveyor R5 conveys the sheet bundle Q on which the second folding is performed downstream from the fifth conveyor R5 via the fifth conveyance passage W5.

Comparative Example

Figure 15A:
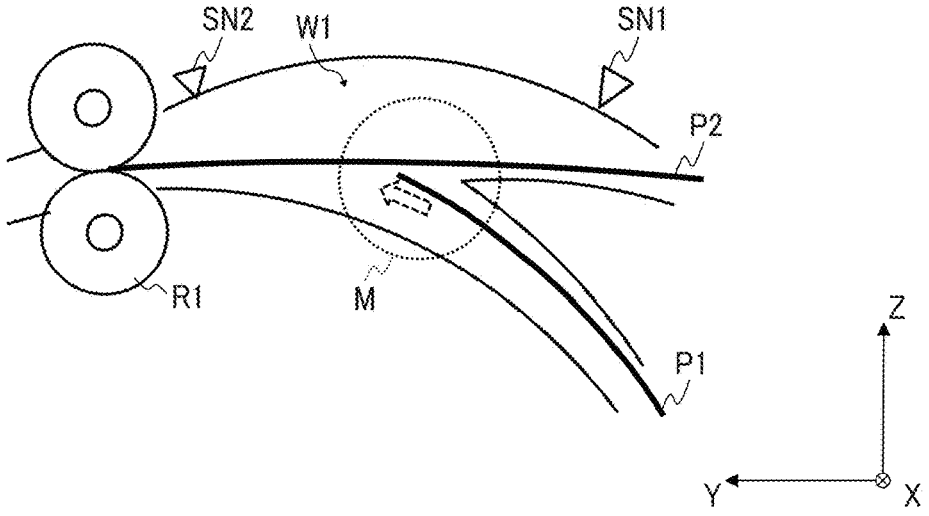
FIG. 15A is an enlarged view of an internal configuration of a sheet folding apparatus according to a comparative example of the present disclosure.
Figure 15B:
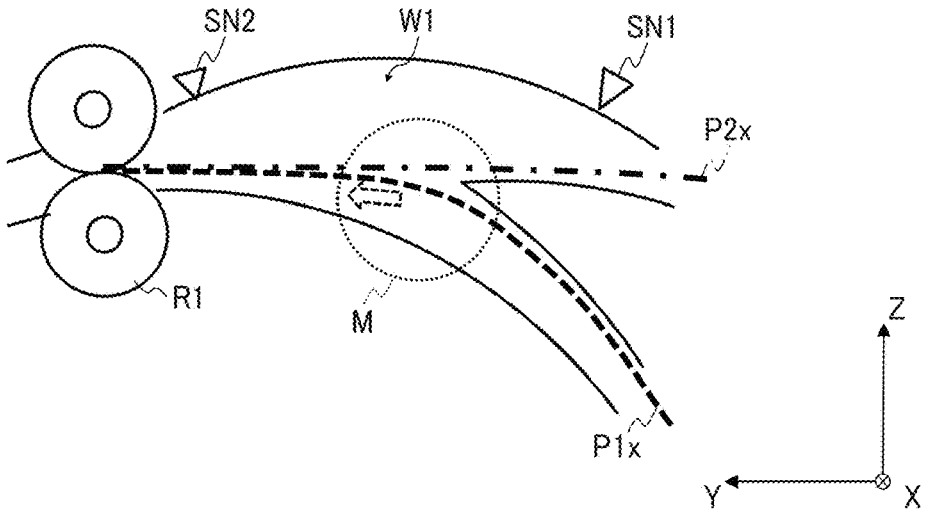
FIG. 15B is an enlarged view of the internal configuration of the sheet folding apparatus of FIG. 15A, illustrating an example of an ideal conveyance state.
Figure 15C:
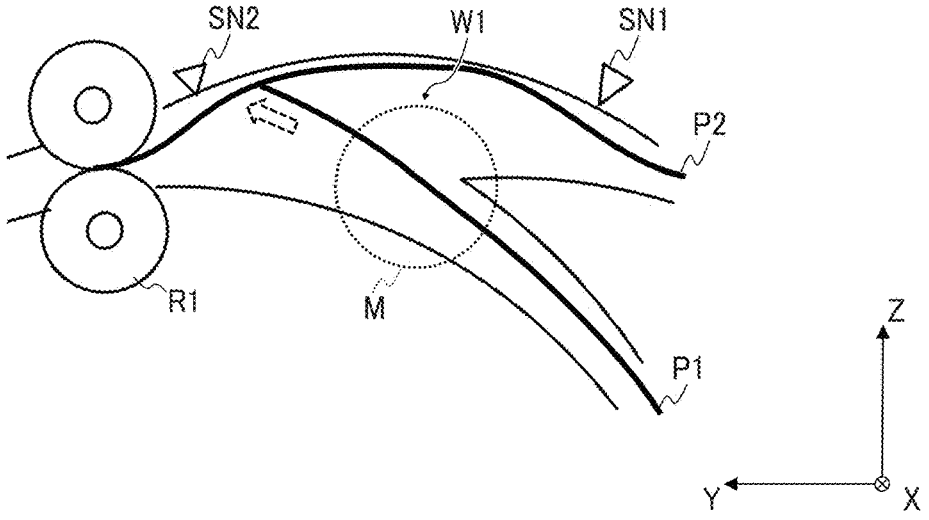
FIG. 15C is an enlarged view of the internal configuration of the sheet folding apparatus of FIG. 15A, illustrating a state in which a subsequent sheet bends in a first conveyance passage.

In order to clarify features according to the embodiment the present disclosure, FIGS. 15A to 15C illustrates an example of the folding unit 200 that does not include a conveyance passage corrector. A failure caused by not including the conveyance passage corrector is described with reference to a comparative example illustrated in FIGS. 15A to 15C.

FIG. 15A illustrates a case in which the preceding sheet P1 circulated to the first conveyance passage W1 via the circulation conveyance passage in a state in which the subsequent sheet P2 is first abutted against the first conveyor R1 in order to overlay the preceding sheet P1 and the subsequent sheet P2. A circle M in FIG. 15A indicates the vicinity of the joining point of a carry-in passage and a circulation passage.

The subsequent sheet P2 is conveyed by the zeroth conveyor R0 while being abutted against the first conveyor R1 until the preceding sheet P1 joins. The subsequent sheet P2 is assumed to be a sheet which is not bent inside the first conveyance passage W1, just as a subsequent sheet P2*x* which is an example of an ideal conveyance state, as illustrated in FIG. 15B. In this case, a preceding sheet P1*x* contacts the subsequent sheet P2*x* at the position of the circle M and passes through the ideal conveyance passage. After that, the preceding sheet P1*x* is conveyed to the first conveyor R1 along the subsequent sheet P2*x*. In this case, overlaying of the preceding sheet P1*x* and the subsequent sheet P2*x* can be performed in an ideal state.

An actual subsequent sheet P2, however, bends in the first conveyance passage W1, just as the subsequent sheet P2 in FIG. 15C, and the preceding sheet P1 does not contact the subsequent sheet P2 at the position of a circle M. Accordingly, a conveyance length of the preceding sheet P1 is longer than a conveyance length of the preceding sheet P1*x* in FIG. 15B which passes through the ideal conveyance passage. In this case, since the conveyance passage length of the preceding sheet P1 is longer than the conveyance length in an ideal conveyance state, the conveyance gap with the subsequent sheet P2 increases.

As a result, when the preceding sheet P1 and the subsequent sheet P2 are overlaid with each other, the ends of the two sheets are shifted. Accordingly, the folded sheet in which the ends are shifted is obtained in the subsequent folding process.

The folding unit 200 according to the present embodiment described below includes the conveyance passage corrector that restricts the conveyance gap as described above. Thus, accuracy of overlaying of the plurality of sheets P can be improved.

Figure 16A:
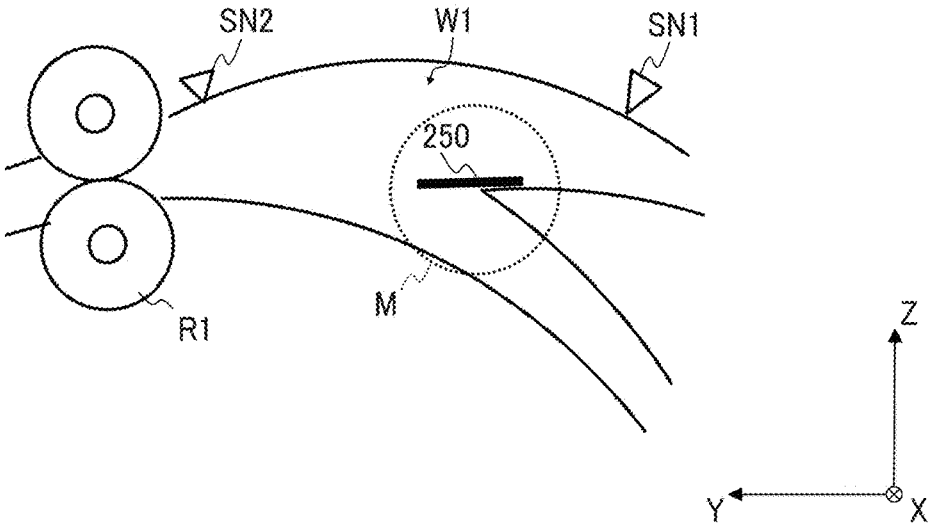
FIG. 16A is a diagram illustrating a conveyance passage correcting operation in a sheet folding apparatus according to an embodiment of the present disclosure.
Figure 16B:
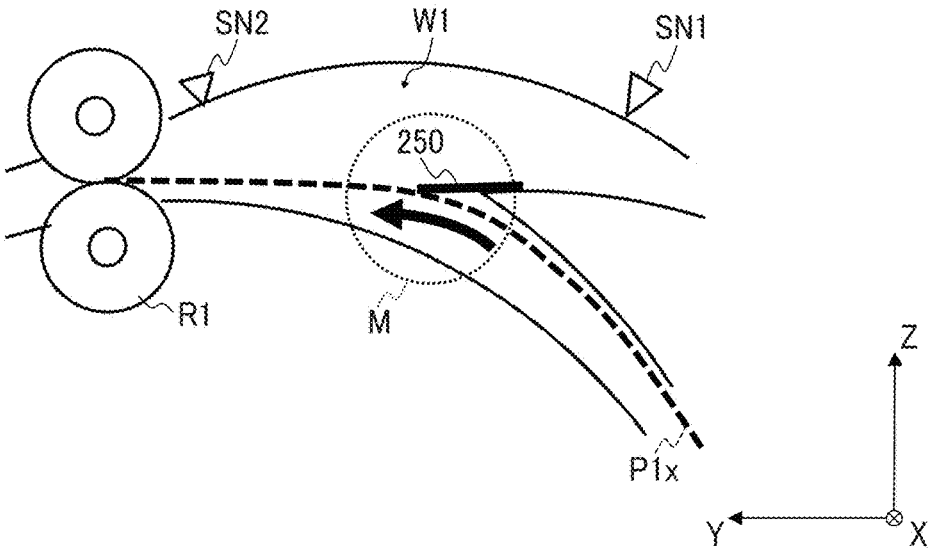
FIG. 16B is a diagram illustrating the conveyance passage correcting operation when the preceding sheet is conveyed toward a first conveyor.
Figure 16C:
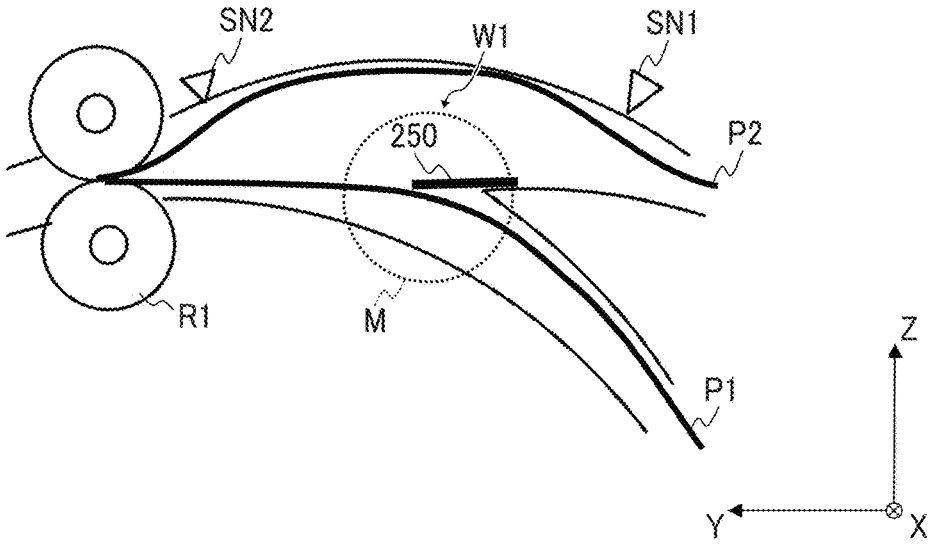
FIG. 16C is a diagram illustrating the conveyance passage correcting operation when the subsequent sheet is conveyed toward the first conveyor.

FIGS. 16A to 16C illustrate a passage corrector 250 serving as a conveyance passage corrector included in the folding unit 200 according to the present embodiment. The passage corrector 250 is disposed at the position of the circle M described above, in other words, at the joining position of the carry-in passage and the circulation passage. The passage corrector 250 is disposed to restrict the conveyance gap as described using the comparative example. Thus, misalignment can be restricted in overlaying of the plurality of sheets P.

As illustrated in FIG. 16A, the passage corrector 250 is disposed at a position according to which the preceding sheet P1 heads toward the first conveyor R1 after the leading end of the preceding sheet P1 circularly conveyed enters the first conveyance passage W1. For example, in the passage corrector 250, the conveyance direction of the preceding sheet P1 and the conveyance direction of the subsequent sheet P2 interfere with each other in the vicinity of the joining point where the sheet P circulates from the third conveyance passage W3 to the first conveyance passage W1. In the process of overlaying a plurality of sheets P, when the conveyance directions of the plurality of sheets P interfere with each other, the conveyance direction of each sheet P at the interference position needs to be corrected to an ideal direction. Accordingly, the passage corrector 250 according to the present embodiment includes a plate-shaped member that protrudes toward the downstream side in the conveyance direction from a joint portion between a guide plate constituting the third conveyance passage W3 and a guide plate constituting the first conveyance passage W1.

When the leading end of the preceding sheet P1 that has been circularly conveyed contacts the plate-shaped member of the passage corrector 250, a direction along a surface direction of the plate-shaped member is the conveyance direction of the preceding sheet P1. The surface direction in this case is a direction toward the first conveyor R1 and corresponds to a downstream direction in the conveyance direction.

As illustrated in FIG. 16B, the conveyance direction of the preceding sheet P1*x* is corrected to be a direction toward the first conveyor R1 by the plate-shaped member included in the passage corrector 250 in the vicinity of the joining position with the circulating passage where the preceding sheet P1*x* returns.

Accordingly, as illustrated in FIG. 16C, even if the subsequent sheet P2 is bent in a state of abutting against the first conveyor R1, the conveyance passage of the preceding sheet P1 is corrected, and the subsequent sheet P2 can abut against the first conveyor R1 in the same manner as the subsequent sheet P2. As a result, overlaying accuracy of the end portions of the plurality of sheets P can be improved.

Figure 17A:
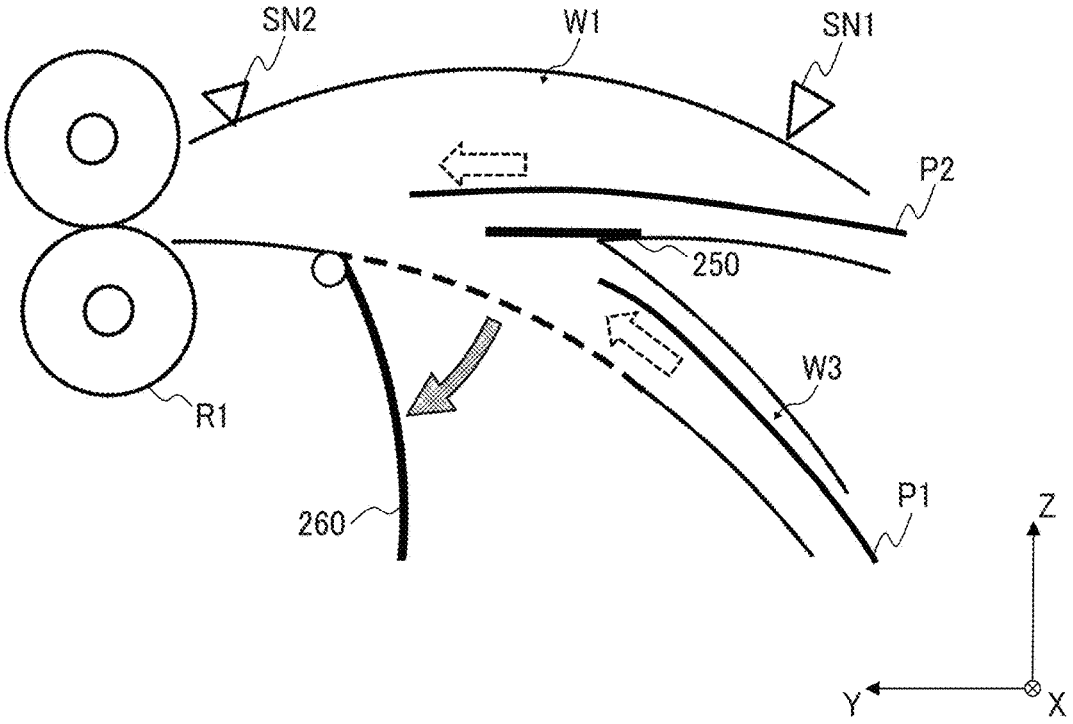
FIG. 17A is a diagram illustrating an assumed failure of a conveyance passage correcting mechanism in a sheet folding apparatus according to an embodiment of the present disclosure.
Figure 17B:
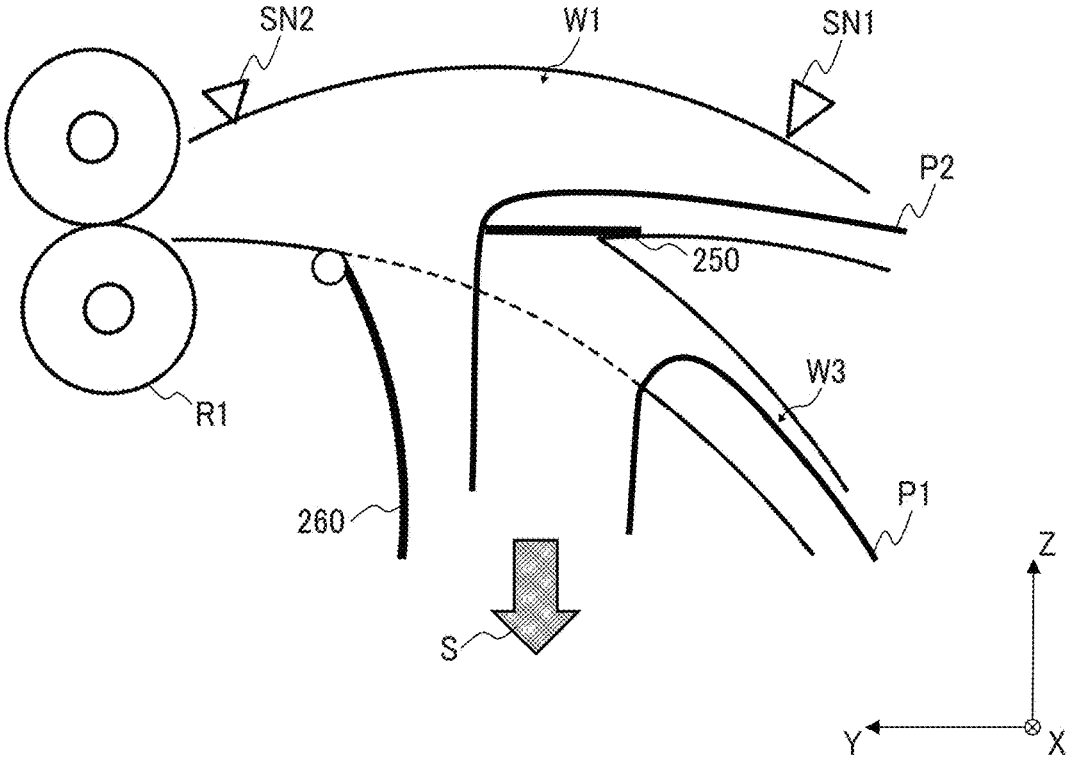
FIG. 17B is a diagram illustrating the conveyance passage correcting mechanism when the subsequent sheet is pulling out.

Next, a further challenge assumed by providing the passage corrector 250 is described with reference to FIGS. 17A and 17B. FIGS. 17A and 17B illustrate a case in which a conveyance failure occurs (jam occurs) while the subsequent sheet P2 is conveyed to the first conveyor R1 via the first conveyance passage W1 serving as a carry-in passage. In order to solve the jam, the subsequent sheet P2 undergoing the conveyance failure needs to be removed.

As illustrated in FIG. 17A, a guide plate 260 is a part of a wall surface encompassing the third conveyance passage W3 and the first conveyance passage W1 and rotates. The guide plate 260 is rotated to form an opening for allowing access to the first conveyance passage W1 from an outside of the folding processing apparatus 200*a*. A user can remove the sheet P remaining due to a conveyance failure by pulling out the sheet P from the opening.

As illustrated in FIG. 17B, in order to pull out the subsequent sheet P2 in a processing direction S and remove the subsequent sheet P2, it is necessary to access a space for pulling out the subsequent sheet P2 (i.e., a space near the joining point between the first conveyance passage W1 and the third conveyance passage W3). However, since the passage corrector 250 is disposed in the space described above, the passage corrector 250 interferes with a removal process. In particular, the processing space of the subsequent sheet P2 is narrowed by the plate-shaped member as the passage corrector 250 protruding toward the joining point. As a result, a processing performance of the process of pulling out the subsequent sheet P2 from the vicinity of the guide plate 260 decreases.

As described above, in a case in which the passage corrector 250 is disposed, the preceding sheet P1 can be conveyed as intended to improve accuracy of overlaying. On the other hand, when a jam occurs in such a case, the processing performance of the removal process the subsequent sheet P2 is decreased. In this regard, the passage corrector 250 according to the present embodiment can solve the assumed failure described above.

Figure 18A:
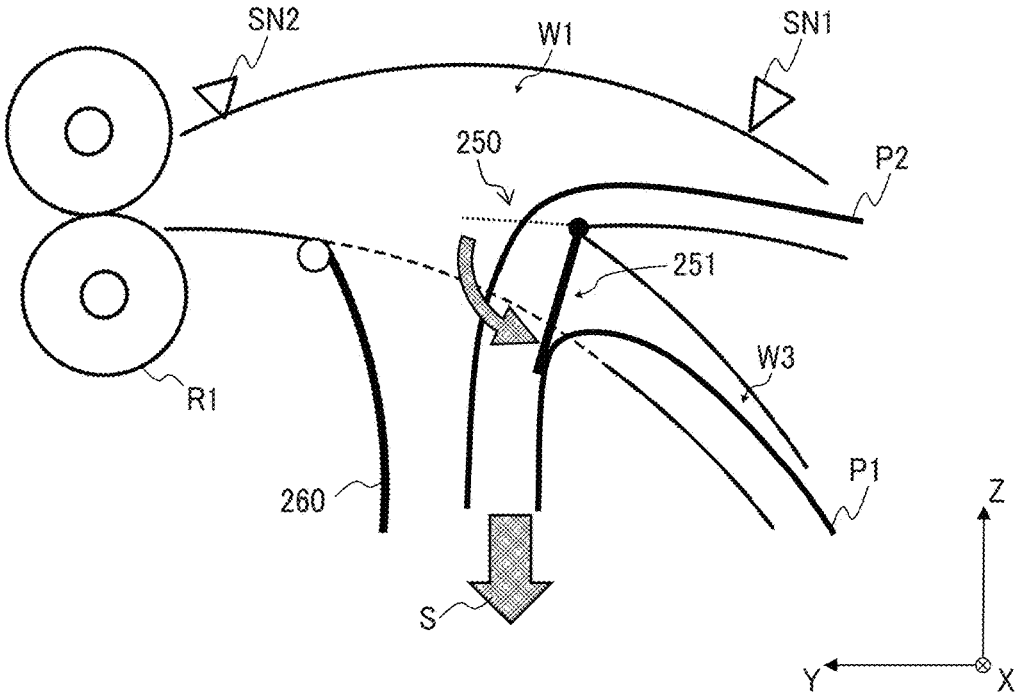
FIG. 18A is a diagram illustrating an operation of a conveyance passage correcting mechanism in a sheet folding apparatus according to an embodiment of the present disclosure.
Figure 18B:
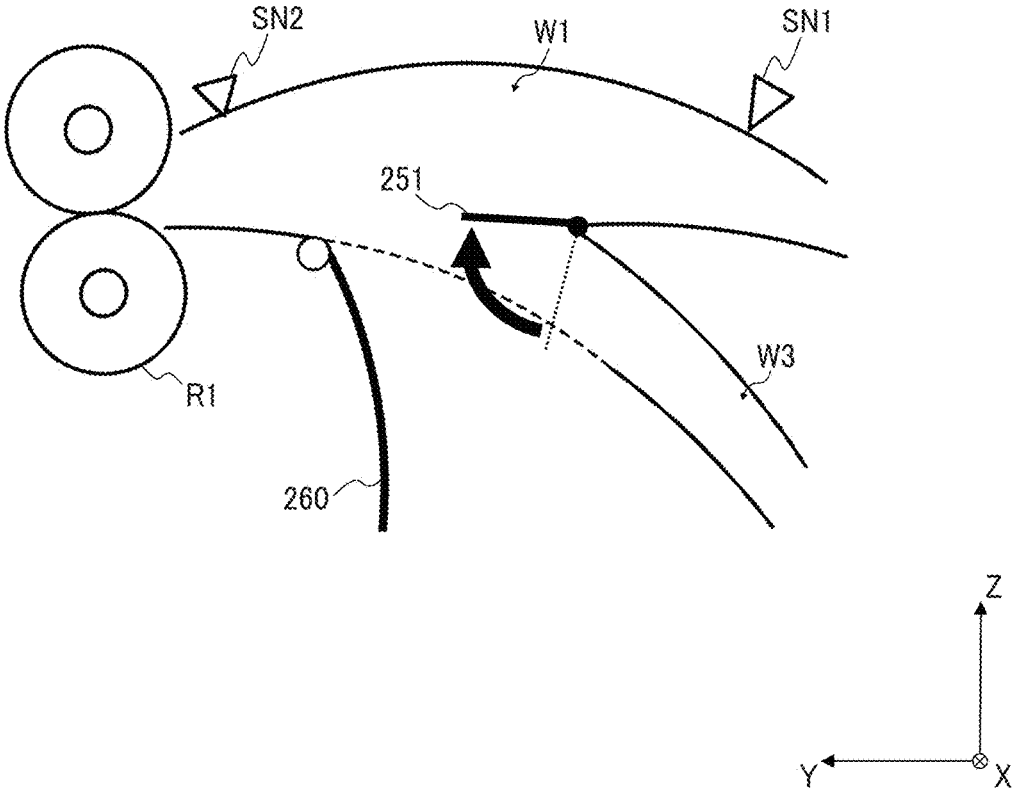
FIG. 18B is a diagram illustrating an operation of the conveyance passage correcting mechanism of FIG. 18A when a correction guide plate returns.

FIGS. 18A and 18B illustrate operations of a correction guide plate 251 included in the passage corrector 250 according to the present embodiment. FIG. 18A illustrates a state in which the guide plate 260 is rotated to the outside of the first conveyance passage W1, and the opening is formed in the first conveyance passage W1 to enable access to the inside. By setting the state illustrated in FIG. 18A, the sheet P undergoing the conveyance failure inside can be accessed to pull and remove the sheet P in the processing direction S.

A leading end of the correction guide plate 251 is rotated in the processing direction S by a tensile force when the subsequent sheet P2 is removed. The correction guide plate 251 is normally biased in a direction opposite to the processing direction S and guides the sheet P conveyed through the carry-in passage to the first conveyor R1. In other words, when a force is applied in the processing direction S and the tensile force is larger than the above-described biasing force, as illustrated in FIG. 18A, the correction guide plate 251 is pulled by the subsequent sheet P2 and moves in a direction of retracting from the processing space. In other words, the passage corrector 250 includes a retracting mechanism that can retract from the conveyance passage in accordance with a force applied in the processing direction S when the sheet P is removed from the conveyance passage. When the conveyance failure of the sheet P occurs, the retracting mechanism is particularly effective in retracting the correction guide plate 251 from the joining position where the sheet P joins from the third conveyance passage W3 to the first conveyance passage W1.

After that, if the subsequent sheet P2 is removed, the force having been applied to the correction guide plate 251 disappears. Thus, the correction guide plate 251 returns to the original state.

One end of an elastic member is fixed to an end portion of the correction guide plate 251 on a downstream side in the conveyance direction. The other end of the elastic member is fixed to a housing of the folding unit 200 to bias the correction guide plate 251 in a direction opposite to the processing direction S.

Accordingly, as illustrated in FIG. 18A, the correction guide plate 251 rotates by a force pulling the sheet P (subsequent sheet P2) in the processing direction (removing direction) when the jam occurs and remains at a position retracted from the removal process during the processing. When the removal of the subsequent sheet P2 is completed, as illustrated in FIG. 18B, the correction guide plate 251 rotates to return to the original state by the biasing of the elastic member.

Figure 19:
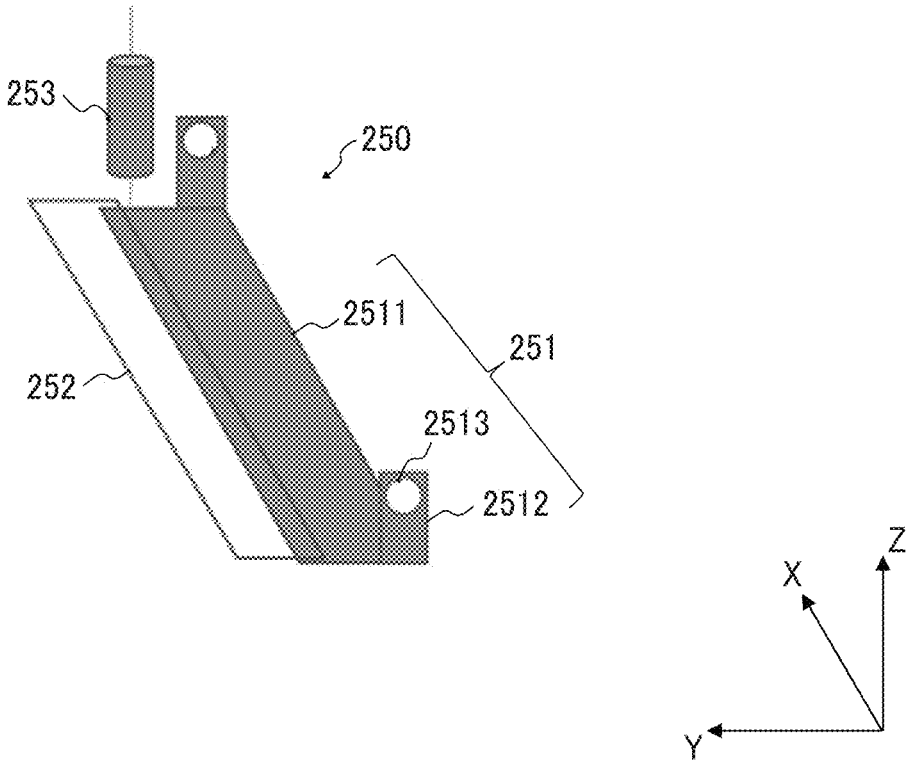
FIG. 19 is a perspective view of a conveyance passage correcting mechanism according to an embodiment of the present disclosure.

Next, an example of a detailed configuration of the passage corrector 250 is described. FIG. 19 is a perspective view of the passage corrector 250 viewed from diagonally forward in the X direction orthogonal to the Y direction that is the conveyance direction of the sheet P, in other words, in the width direction of the sheet P. As illustrated in FIG. 19, the passage corrector 250 includes the correction guide plate 251, an elastic material portion 252, and a first biasing member 253.

The correction guide plate 251 includes a plate 2511 and a plate holding portion 2512. The plate 2511 is a plate-shaped member that corrects the conveyance direction of the preceding sheet P1 conveyed through the circulating passage to the direction (Y direction) of the first conveyor R1. The plate holding portion 2512 holds the plate 2511 at a predetermined position. The plate holding portion 2512 is provided with a shaft hole 2513. The shaft hole 2513 is a rib standing from an end portion of the plate 2511 in the X direction toward the Z direction and rotatably holds the plate 2511.

The elastic material portion 252 serving as an elastic member disposed on the plate 2511 is a plate-shaped member disposed at an end portion on the downstream side in the conveyance direction of the plate 2511 and is formed of a material more flexible than the plate 2511. The elastic material portion 252 is an elastic member that is deformable in the vertical direction with respect to the conveyance direction. The flexibility of the elastic material portion 252 may be deformable in a direction orthogonal to the conveyance direction of the sheet P by an external force applied in the processing direction of removing the sheet P when a jam has occurred. The elastic member may be any elastic member that can be restored to the original position when the external force applied in the processing direction disappears.

One end of the first biasing member 253 is fixed to an end portion of the plate 2511. The other end of the first biasing member 253 is fixed to a housing of the folding unit 200, for example. The first biasing member 253 is a biasing member that applies a biasing force to pull up the end portion of the plate 2511 on the downstream side in the conveyance direction upward (Z direction) with respect to the conveyance direction. The correction guide plate 251 returns to a predetermined position by the biasing of the first biasing member 253 when the force in the processing direction in the removal process of the sheet P disappears.

The correction guide plate 251 is pivotally supported at a predetermined position by inserting a pin fixed to the housing of the folding unit 200 into the shaft hole 2513 formed in the plate holding portion 2512. The correction guide plate 251 rotates in the Z-Y plane with the shaft hole 2513 as a rotation center.

Accordingly, when a downward force with respect to the conveyance direction is applied to the elastic material portion 252 disposed at the end portion on the downstream side in the conveyance direction and the elastic material portion 252 reaches the deformation limit, the correction guide plate 251 rotates at the end portion on the downstream side in the conveyance direction. As a result, the correction guide plate 251 can retract from the vicinity of the joining position.

When the downward force in the conveyance direction is further applied and the deformation of the elastic material portion 252 reaches a deformation limit at which the elastic material portion 252 is not deformed any more, the plate 2511 is rotated in the downward direction in the conveyance direction by the force applied to the elastic material portion 252. As a result, the passage corrector 250 is further retracted from the vicinity of the joining position. Thus, a processing space for pulling out the jammed subsequent sheet P2 can be secured.

Figure 20A:
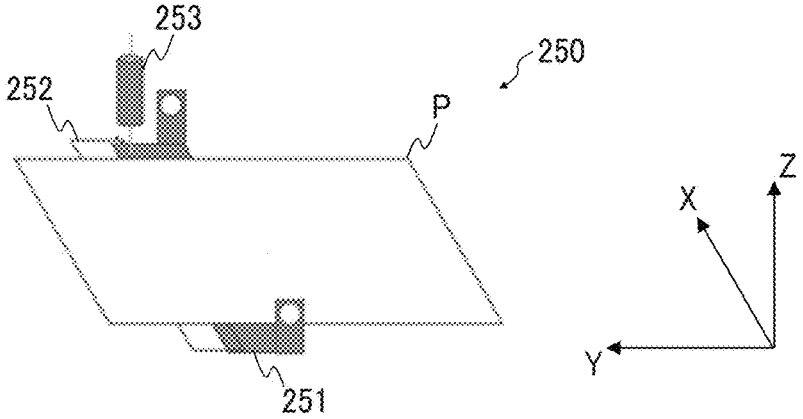
FIG. 20A is a diagram illustrating an operation of the conveyance passage correcting mechanism of FIG. 19.

Next, an operation of the passage corrector 250 when the removal process of the sheet P is performed is described with reference to FIGS. 20A to 20D. FIG. 20A illustrates a jam state in which the sheet P stops due to a conveyance failure at the joining point of the circulation passage and the carry-in passage, that is, in which the sheet P remains on the conveyance passage. In the jam state, a process (removal process) of pulling out the remaining sheet P in the downward direction (−Z direction) of the conveyance direction is performed.

Figure 20B:
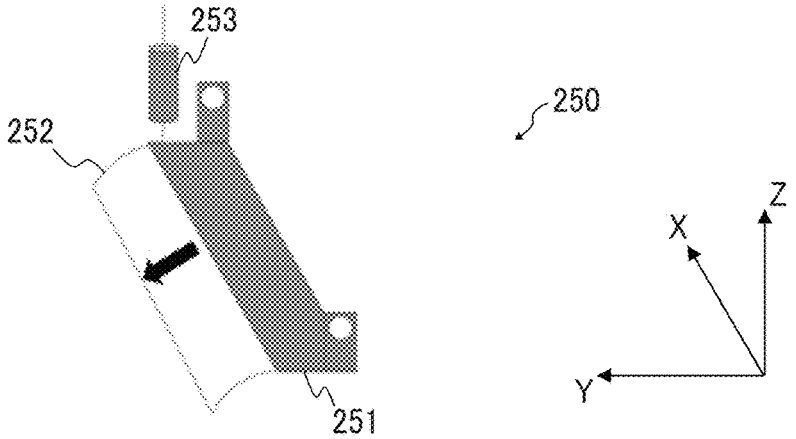
FIG. 20B is a diagram illustrating a jam state in which a sheet stops due to a conveyance failure in the conveyance passage correcting mechanism.

When the sheet P is pulled downward in the conveyance direction by the removal process, an external force in the downward direction is applied to the elastic material portion 252 at the end portion of the correction guide plate 251 on the downstream side in the conveyance direction. This state is illustrated in FIG. 20B. Due to the deformation of the elastic material portion 252, the downstream end portion of the correction guide plate 251 in the conveyance direction is in a state of being retracted from the position where the sheet P remains.

Figure 20C:
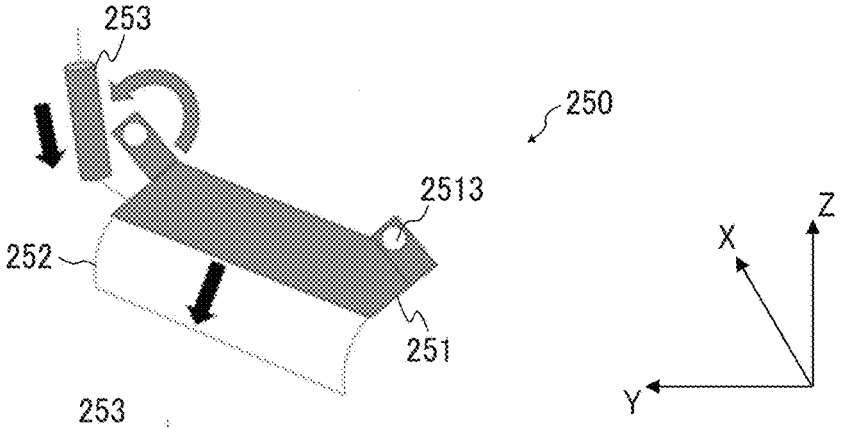
FIG. 20C is a diagram illustrating a state in which the jammed sheet is pulled.
Figure 20D:
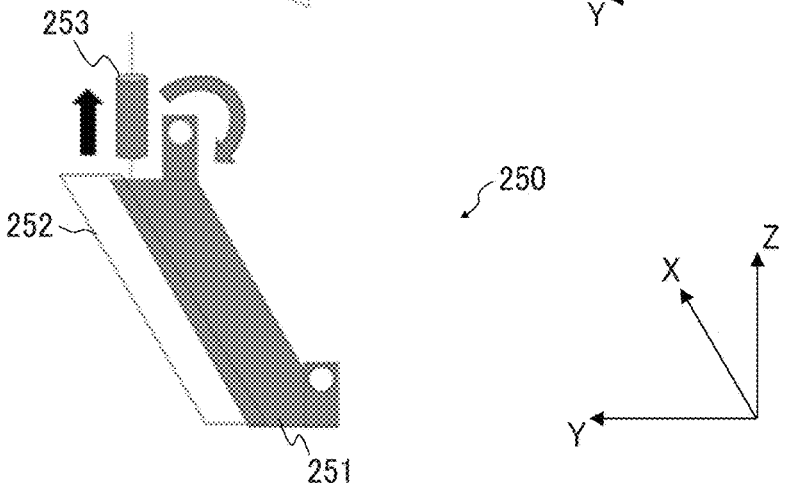
FIG. 20D is a diagram illustrating a state in which the jammed sheet is removed and a correction guide plate is returned to an original position.

When the sheet P is further pulled, the external force exceeds the tensile force of the first biasing member 253 as illustrated in FIG. 20C. As a result, the correction guide plate 251 rotates around the shaft hole 2513, and the downstream end portion in the conveyance direction rotates downward (−Z direction).

After that, as illustrated in FIG. 20C, when the sheet P is removed, the correction guide plate 251 is rotated by the tensile force of the first biasing member 253 and returns to the original position as illustrated in FIG. 20A.

As described above, when the sheet P is removed from the conveyance passage, the passage corrector 250 is retracted from the space for the removal process by the pulling force for removing the sheet P. Thus, a situation in which the sheet P is easily removed can be realized. When the jammed sheet P is removed, the passage corrector 250 is restored to the initial position. As a result, processing performance can improve by securing the processing space at the time of the removal process. Further, since the passage corrector 250 is automatically restored to the original state when the removal process is finished, the deterioration of the processing performance of the conveyance failure can be restricted.

In the present embodiment, the first biasing member 253 is exemplified as the biasing force for restoring the correction guide plate 251 to the initial position. However, the member for restoring the correction guide plate 251 is not limited to above-described configuration. For example, a member having a characteristic of deforming and restoring to the original state, such as a torsion coil spring, can be used.

Figure 21A:
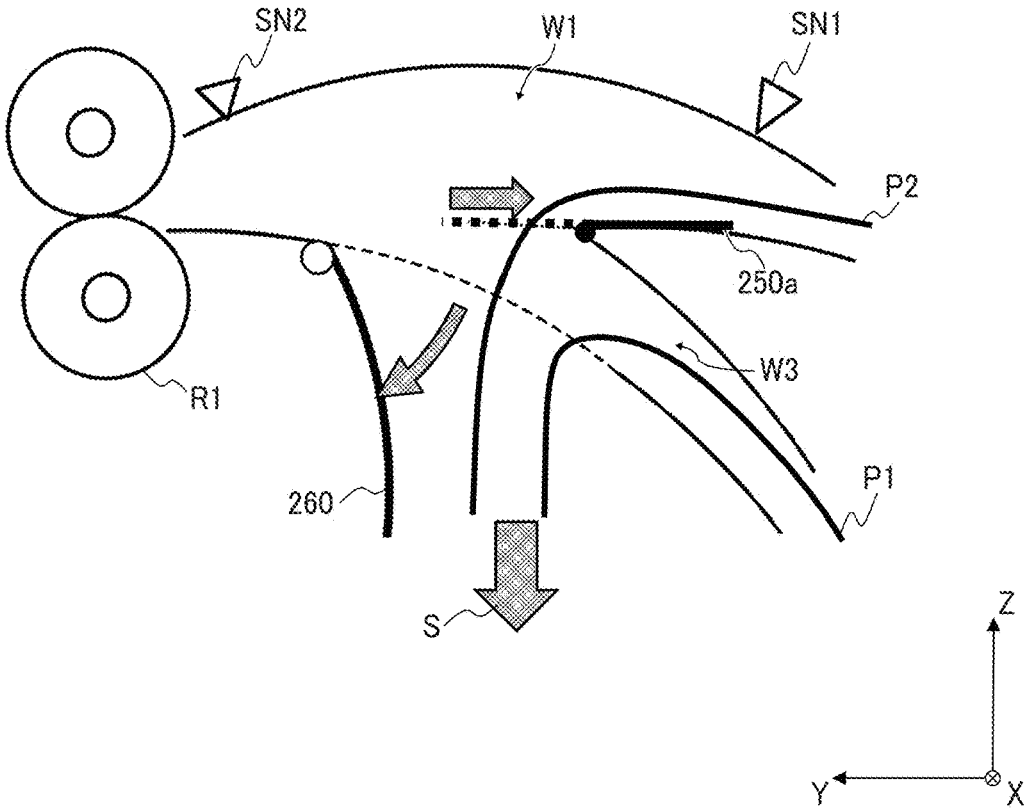
FIG. 21A is a diagram illustrating a conveyance passage correcting mechanism according to another embodiment of the present disclosure.
Figure 21B:
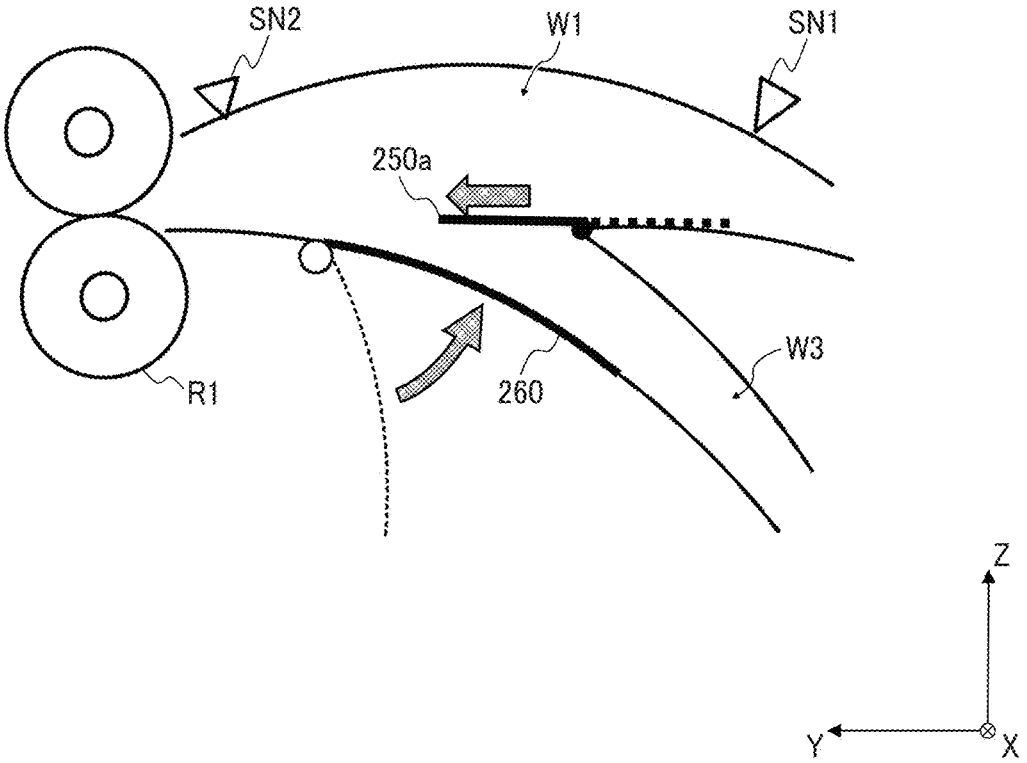
FIG. 21B is a diagram illustrating a state in which a guide plate is closed after the jammed sheet is removed.

Next, a description is given of a conveyance passage corrector included in the post-processing apparatus, according to another embodiment of the present disclosure. FIGS. 21A and 21B illustrate a passage corrector 250*a* serving as a conveyance passage corrector included in the folding unit 200 according to the present embodiment. The passage corrector 250*a* can be retracted to the upstream side in the conveyance direction. After the jammed sheet P is removed, the passage corrector 250*a* can be restored to the original position. The "original position" of the passage corrector 250*a* corresponds to a position at which the conveyance direction of the preceding sheet P1 conveyed via the circulating passage can be corrected to the first conveyor R1.

When the subsequent sheet P2 undergoes a conveyance failure at the joining position with the circulating passage, a jam sensor included in the various sensors 240 outputs a detection signal to the post-processing controller 210. The post-processing controller 210 notifies a user of the occurrence of the jam and moves the passage corrector 250*a* toward the zeroth conveyor R0 as illustrated in FIG. 21A. Accordingly, as illustrated in FIG. 21A, the passage corrector 250*a* can be retracted from the space for removing the sheet P, and the processing space can be secured. As a result, the sheet P can be pulled out in the processing direction S.

An end portion of the passage corrector 250*a* on the downstream side in the conveyance direction may also be made of an elastic material as in the passage corrector 250. Accordingly, even if a load is applied to the leading end of the passage corrector 250*a* when the sheet P is removed, the force due to the load can be released by bending. Thus, the removal of the sheet P can be easily performed.

The guide plate 260 may be rotated thereby making a sensor detect formation of an opening. The post-processing controller 210 may perform the retracting operation of the passage corrector 250 triggered by a detection signal of an opening and closing sensor of the guide plate 260.

As illustrated in FIG. 21B, when the opening and closing sensor detects that the guide plate 260 is closed, the post-processing controller 210 may perform a restoring operation to return the passage corrector 250 to the original position.

Figure 22:
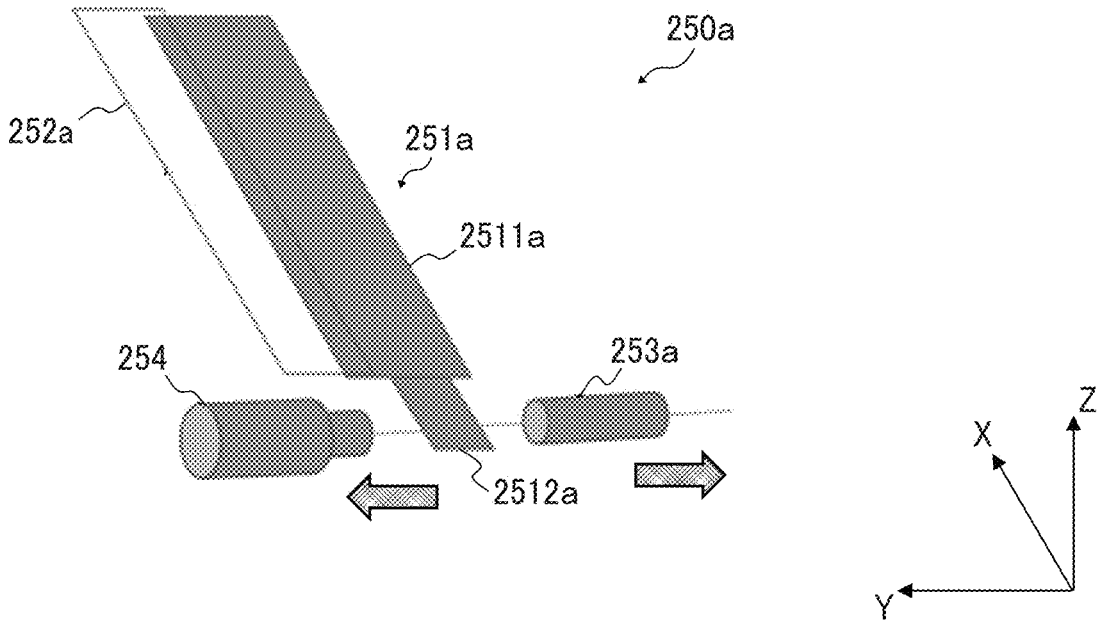
FIG. 22 is a perspective view of an example of the structure of the conveyance passage correcting mechanism of FIG. 21A.

Next, an example of a detailed structure of the passage corrector 250*a* is described. FIG. 22 is a perspective view of the passage corrector 250*a* as viewed from diagonally forward in the X direction which is orthogonal to the Y direction as the conveyance direction of the sheet P. As illustrated in FIG. 22, the passage corrector 250*a* includes a correction guide plate 251*a*, an elastic material portion 252*a*, a second biasing member 253*a*, and a solenoid 254.

The correction guide plate 251*a* includes a plate 2511*a* and a movement holding portion 2512*a*. The plate 2511*a* corresponds to a plate-shaped member that corrects the conveyance direction of the preceding sheet P1 conveyed through the circulating passage to the direction (Y direction) of the first conveyor R1. The movement holding portion 2512*a* is a rib protruding in the X direction from an end portion of the plate 2511*a* in the X direction and moves the correction guide plate 251*a* to a predetermined position.

The elastic material portion 252*a* is a plate-shaped member to which an end portion of the plate 2511*a* on the downstream side in the conveyance direction is attached to extend the plate 2511*a* in the conveyance direction. The elastic material portion 252*a* is made of an elastically deformable material.

One end of the second biasing member 253*a* is fixed to the movement holding portion 2512*a* which is an end portion of the plate 2511*a*. The other end of the second biasing member 253*a* is fixed to a housing of the folding unit 200, for example. The second biasing member 253*a* biases the correction guide plate 251*a* to slide toward the upstream side in the conveyance direction. The second biasing member 253*a* is an elastic member that exerts a tensile force for sliding the correction guide plate 251*a* from the joining position to a retracted position.

When the solenoid 254 is turned on, the solenoid 254 biases the movement holding portion 2512*a* to pull the movement holding portion 2512*a* toward the downstream side in the conveyance direction. The post-processing controller 210 performs an operation of the solenoid 254. When the opening and closing sensor of the guide plate 260 detects that the guide plate 260 is opened, the post-processing controller 210 turns off the solenoid 254. Accordingly, the correction guide plate 251*a* is moved to the upstream side in the conveyance direction by the biasing force of the second biasing member 253*a*. When the opening and closing sensor detects that the guide plate 260 is closed, the solenoid 254 is turned on. The biasing force of the solenoid 254 is set to be larger than the biasing force of the second biasing member 253*a*. As a result, when the solenoid 254 is turned on, the correction guide plate 251*a* is held at the joining position (see FIG. 21A).

Figure 23A:
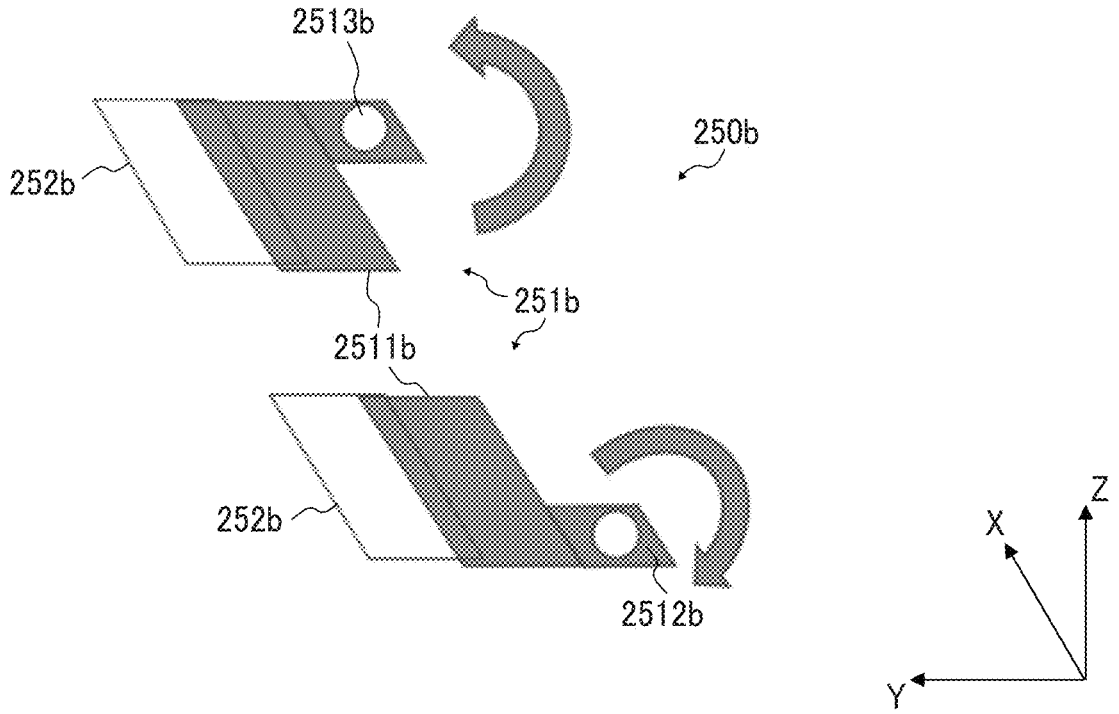
FIG. 23A is a perspective view of a conveyance passage correcting mechanism according to still another embodiment of the present disclosure.
Figure 23B:
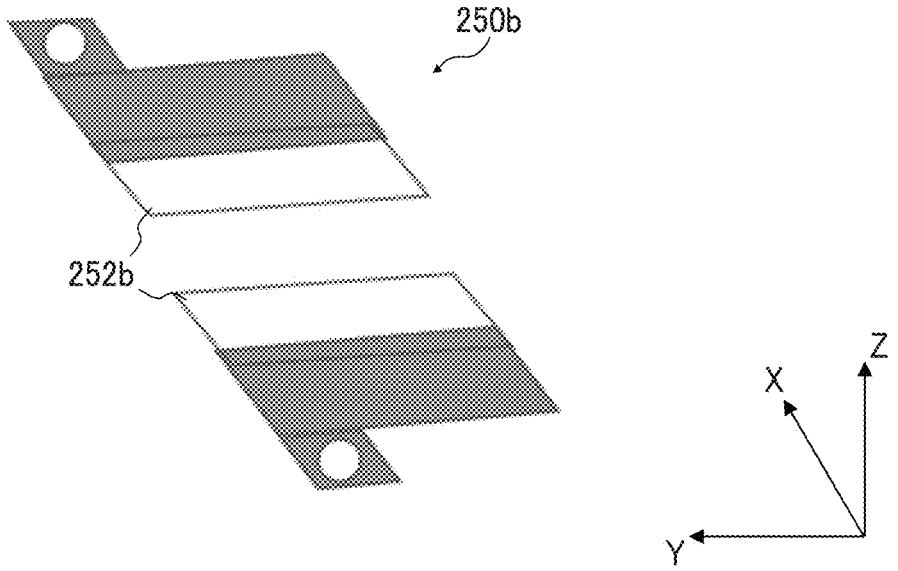
FIG. 23B is a diagram illustrating a state in which plates are rotated around axial holes.

Next, still another embodiment of a conveyance passage corrector included in the post-processing apparatus according to the present disclosure is described. FIGS. 23A and 23B are perspective views of a passage corrector 250*b* according to the present embodiment when viewed from diagonally forward in the X direction which is a direction orthogonal to the Y direction as the conveyance direction of the sheet P. As illustrated in FIGS. 23A and 23B, the passage corrector 250*a* includes a correction guide plate 251*b* and an elastic material portion 252*b*. The correction guide plate 251*b* is biased in a predetermined direction to rotate around a shaft hole 2513*b*.

The correction guide plate 251*b* includes a plate 2511*b* and a rotation holding portion 2512*b*. The plate 2511*b* corresponds to a plate-shaped member that corrects the conveyance direction of the preceding sheet P1 conveyed through the circulating passage to the direction (Y direction) of the first conveyor R1. The rotation holding portion 2512*b* is a rib protruding from an upstream end of the plate 2511*b* in the Y direction and rotates the correction guide plate 251*b* at a predetermined position.

The elastic material portion 252*b* is a plate-shaped member to which an end portion of the plate 2511*b* on the downstream side in the conveyance direction is attached to extend the plate 2511*b* in the conveyance direction. The elastic material portion 252*b* is made of an elastically deformable material.

The passage corrector 250*b* is in the state illustrated in FIG. 23A when receiving the subsequent sheet P2 and conveying the circularly conveyed preceding sheet P1 toward the first conveyor R1. In this case, the preceding sheet P1 is conveyed along the correction guide plate 251*b* without being affected by the bend of the subsequent sheet P2.

When the subsequent sheet P2 undergoes a conveyance failure, the plate 2511*b* is rotated around the shaft hole 2513*b* as illustrated in FIG. 23B. Accordingly, the correction guide plate 251*b* can be retracted from the joining position.

A power of a motor may be used as a driving source to rotate the correction guide plate 251*b*. A driving force from the driving source may be transmitted via a gear.

As described above, according to the folding unit 200 of the present embodiment, when post-processing including overlaying process of a plurality of sheets is performed, the leading-end-alignment accuracy and the skew-correction accuracy of the overlaid sheets can be improved. When a conveyance failure occurs in a configuration in which a plurality of sheets are stacked, the processing performance of the removal process of the sheet undergoing a conveyance failure can be improved.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A post-processing apparatus comprising:

a first conveyor configured to convey a sheet conveyed along a first conveyance passage downstream from the first conveyor;

a second conveyor configured to convey the sheet along a second conveyance passage;

a third conveyor configured to convey the sheet along a third conveyance passage; and a conveyance passage corrector configured to retract from a joining position at which the third conveyance passage joins to the first conveyance passage, and turn a conveyance direction of the sheet toward the first conveyor when the sheet enters from the third conveyance passage to the first conveyance passage wherein the conveyance passage corrector includes:

a plate configured to correct the conveyance direction of the sheet in the first conveyance passage;

a biasing member configured to bias a surface direction of the plate toward the first conveyor; and an elastic member disposed at a downstream end of the plate in the conveyance direction, the elastic member being deformable in a direction orthogonal to the conveyance direction.

2. The post-processing apparatus according to claim 1, wherein the conveyance passage corrector is disposed at a position where a conveyance direction of a preceding sheet circularly conveyed and a conveyance direction of a subsequent sheet carried interfere each other.

3. The post-processing apparatus according to claim 1, wherein when the sheet that a conveyance problem has occurred in the first conveyance passage is removed, the plate is configured to:

rotate in the direction orthogonal to the conveyance direction;

retract from the joining position; and return to the joining position after removal of the sheet.

4. The post-processing apparatus according to claim 1, wherein when the sheet to which a conveyance failure has occurred in the first conveyance passage is removed, pulling the sheet in a removal direction deforms the elastic member, and wherein when the elastic member reaches a deformation limit, the plate is configured to:

rotate in the direction orthogonal to the conveyance direction;

retract from the joining position; and return to the joining position after removal of the sheet.

5. The post-processing apparatus according to claim 1, wherein the plate is divided in the direction orthogonal to the conveyance direction, and wherein when the sheet in the first conveyance passage is removed, the plate is configured to:

rotate in the direction orthogonal to the conveyance direction;

retract from the joining position; and return to the joining position after removal of the sheet.

6. The post-processing apparatus according to claim 1, wherein when the sheet in the first conveyance passage is removed, the plate is configured to:

slide in the direction orthogonal to the conveyance direction;

retract from the joining position; and return to the joining position after removal of the sheet.

7. An image forming apparatus comprising:

an image forming device configured to form an image onto a sheet; and the post-processing apparatus according to claim 1 configured to perform post-processing on the sheet.

8. An image forming system comprising:

an image forming apparatus including an image forming device to form an image onto a sheet; and the post-processing apparatus according to claim 1, wherein the image forming apparatus is coupled to the post-processing apparatus.

* * * * *